US010012045B2

(12) United States Patent
Lajesic

(10) Patent No.: US 10,012,045 B2
(45) Date of Patent: Jul. 3, 2018

(54) DEFLECTOR ASSEMBLY FOR A LATERAL WELLBORE

(71) Applicant: HALLIBURTON ENERGY SERVICES, INC., Houston, TX (US)

(72) Inventor: Borisa Lajesic, Addison, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/382,280

(22) PCT Filed: Nov. 1, 2013

(86) PCT No.: PCT/US2013/068069
§ 371 (c)(1),
(2) Date: Aug. 29, 2014

(87) PCT Pub. No.: WO2015/030842
PCT Pub. Date: Mar. 5, 2015

(65) Prior Publication Data

US 2016/0290079 A1 Oct. 6, 2016

Related U.S. Application Data

(60) Provisional application No. 61/872,655, filed on Aug. 31, 2013.

(51) Int. Cl.
*E21B 17/18* (2006.01)
*E21B 23/12* (2006.01)
*E21B 41/00* (2006.01)

(52) U.S. Cl.
CPC ..... *E21B 23/002* (2013.01); *E21B 17/18* (2013.01); *E21B 41/0035* (2013.01)

(58) Field of Classification Search
CPC ..... E21B 17/18; E21B 23/002; E21B 41/0035
(Continued)

(56) References Cited

U.S. PATENT DOCUMENTS 4,224,986 A 9/1980 Rothberg
4,508,166 A 4/1985 Becker et al.
(Continued)

FOREIGN PATENT DOCUMENTS

CN 1514913 7/2004
CN 200955400 10/2007
(Continued)

OTHER PUBLICATIONS

International Search Report and Written Opinion of PCT Application No. PCT/US2013/068069 dated May 26, 2014: pp. 1-15.

*Primary Examiner* — Taras P Bemko
(74) *Attorney, Agent, or Firm* — Chamberlain Hrdlicka

(57) ABSTRACT

A deflector assembly includes an upper deflector arranged within a main bore of a wellbore, the upper deflector having first and second plates spaced apart by a distance. At least one of the first and second plates includes a ramped surface. A lower deflector is arranged within the main bore, the lower deflector defining a first conduit and a second conduit. One of the first and second conduits is in communication with a lower portion of the main bore and another of the first and second conduits is in communication with a lateral bore. The upper and lower deflectors are configured to direct a bullnose assembly into either the lateral bore or the lower portion of the main bore based on a size of a bullnose tip of the bullnose assembly.

20 Claims, 18 Drawing Sheets

(58) Field of Classification Search
USPC ..... 166/381
See application file for complete search history.

(56) References Cited

U.S. PATENT DOCUMENTS

| | | | | |
|---|---|---|---|---|
| 5,353,876 | A | 10/1994 | Curington et al. | |
| 5,499,680 | A | 3/1996 | Walter et al. | |
| 5,526,880 | A * | 6/1996 | Jordan, Jr. ..... | E21B 33/16 166/291 |
| 6,158,513 | A | 12/2000 | Nistor et al. | |
| 6,527,067 | B1 * | 3/2003 | Ravensbergen .... | E21B 41/0035 175/381 |
| 6,880,974 | B2 | 4/2005 | Moshammer | |
| 8,695,694 | B1 | 4/2014 | Lajesic | |
| 8,701,775 | B2 | 4/2014 | Steele | |
| 2009/0194292 | A1 | 8/2009 | Oglesby | |
| 2010/0252275 | A1 | 10/2010 | Cronley et al. | |
| 2011/0203847 | A1 | 8/2011 | Randall et al. | |

FOREIGN PATENT DOCUMENTS

| | | |
|---|---|---|
| CN | 201738824 | 2/2011 |
| RU | 2189429 | 9/2002 |
| RU | 70920 | 2/2008 |
| WO | 2015012843 | 1/2015 |
| WO | 2015012844 | 1/2015 |
| WO | 2015012845 | 1/2015 |

* cited by examiner

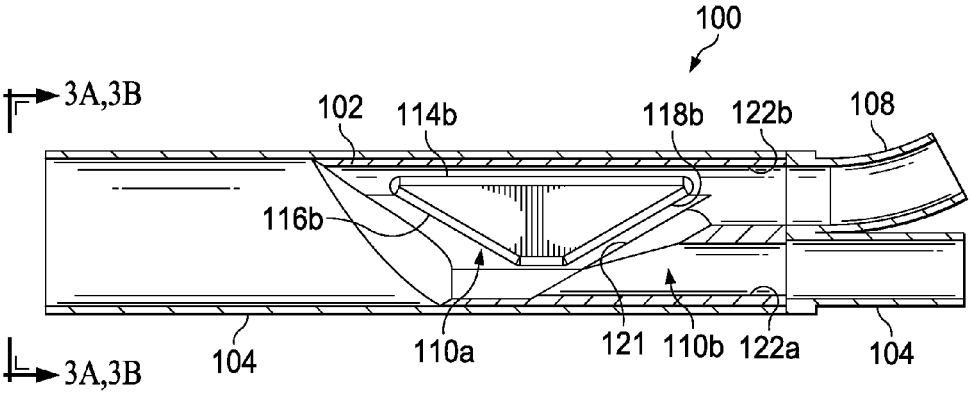
FIG. 2
FIG. 3A
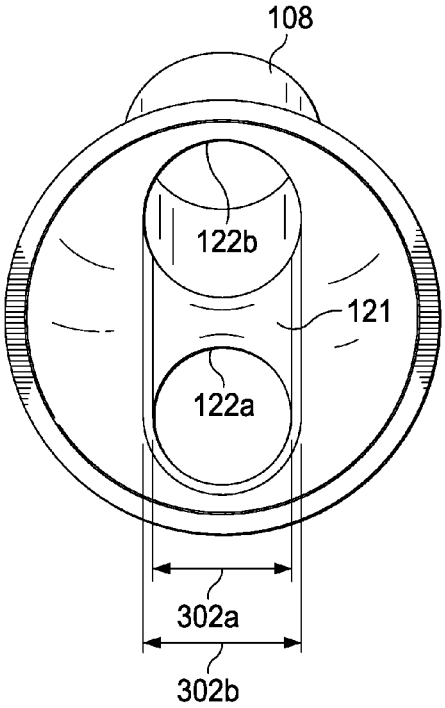
FIG. 3B
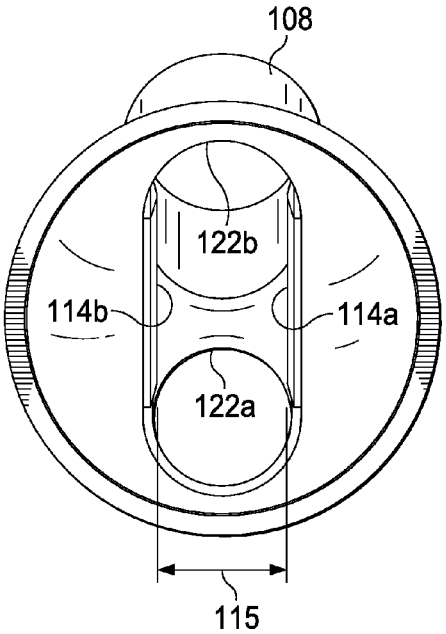

DEFLECTOR ASSEMBLY FOR A LATERAL WELLBORE

BACKGROUND

The present disclosure relates generally to a wellbore selector assembly and, to a multi-deflector assembly for guiding a bullnose assembly into a selected borehole within a wellbore.

Wells are drilled at various depths to access and produce oil, gas, minerals, and other naturally-occurring deposits from subterranean geological formations. Hydrocarbons may be produced through a wellbore traversing the subterranean formations. The wellbore may be relatively complex and include, for example, one or more lateral branches extending at an angle from a parent or main wellbore. Such wellbores are commonly called multilateral wellbores. Various devices and downhole tools can be installed in a multilateral wellbore in order to direct assemblies towards a particular lateral wellbore. A deflector, for example, is a device that can be positioned in the main wellbore at a junction and configured to direct a bullnose assembly conveyed downhole toward a lateral wellbore. Some deflectors may also allow the bullnose assembly to remain within the main wellbore and otherwise bypass the junction without being directed into the lateral wellbore.

Accurately directing the bullnose assembly into the main wellbore or the lateral wellbore can often be a difficult undertaking. For instance, accurate selection between wellbores commonly requires that both the deflector and the bullnose assembly be correctly orientated within the well. Some deflectors rely upon gravity to properly deflect or direct the bullnose assembly, which can be challenging when deflectors are positioned in vertical or non-horizontal wellbores or when deflectors are oriented within the wellbore in such a way that prevents the gravitational force from cooperating with the deflector to properly direct the bullnose assembly.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

FIG. 2 depicts a cross-sectional side view of the deflector assembly of FIG. 1;

FIGS. 3A and 3B illustrate end views of the deflector assembly of FIGS. 1A and 1B with movable plates in the retracted (FIG. 3A) and extended (FIG. 3B) position, according to one or more embodiments;

DETAILED DESCRIPTION OF ILLUSTRATIVE EMBODIMENTS

Figure 1A:
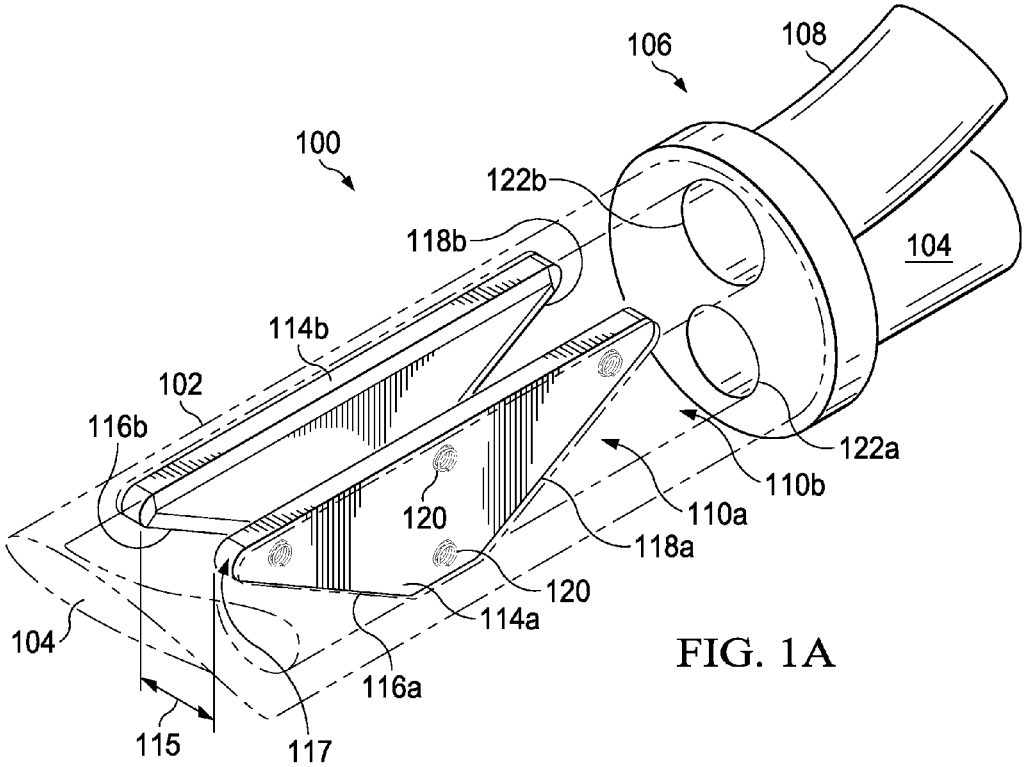
FIGS. 1A and 1B depict isometric and isometric exploded views of a deflector assembly, according to one or more embodiments of the disclosure.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

As used herein, the phrases "hydraulically coupled," "hydraulically connected," "in hydraulic communication," "fluidly coupled," "fluidly connected," and "in fluid communication" refer to a form of coupling, connection, or communication related to fluids, and the corresponding flows or pressures associated with these fluids. In some embodiments, a hydraulic coupling, connection, or communication between two components describes components that are associated in such a way that fluid pressure may be transmitted between or among the components. Reference to a fluid coupling, connection, or communication between two components describes components that are associated in such a way that a fluid can flow between or among the components. Hydraulically coupled, connected, or communicating components may include certain arrangements where fluid does not flow between the components, but fluid pressure may nonetheless be transmitted such as via a diaphragm or piston.

The embodiments described herein relate to systems and methods capable of being disposed or performed in a wellbore, such as a parent wellbore, of a subterranean formation and within which a branch wellbore may be formed and completed. A "parent wellbore" or "parent bore" refers to a wellbore from which another wellbore is drilled. It is also referred to as a "main wellbore" or "main bore". A parent or main bore does not necessarily extend directly from the earth's surface. For example, it can be a branch wellbore of another parent wellbore. A "branch wellbore," "branch bore," "lateral wellbore," or "lateral bore" refers to a wellbore drilled outwardly from its intersection with a parent wellbore. Examples of branch wellbores include a lateral wellbore and a sidetrack wellbore. A branch wellbore may have another branch wellbore drilled outwardly from it such that the first branch wellbore is a parent wellbore to the second branch wellbore.

While a parent wellbore may in some instances be formed in a substantially vertical orientation relative to a surface of the well, and while the branch wellbore may in some instances be formed in a substantially horizontal orientation relative to the surface of the well, reference herein to either the parent wellbore or the branch wellbore is not meant to imply any particular orientation, and the orientation of each of these wellbores may include portions that are vertical, non-vertical, horizontal or non-horizontal.

The present disclosure relates generally to a wellbore selector assembly for guiding a bullnose assembly into a selected borehole within a wellbore.

The disclosure describes exemplary deflector assemblies that are able to accurately deflect a bullnose assembly into either a main wellbore or a lateral wellbore based on a size parameter such as a width (e.g., a diameter) or a length of the bullnose assembly or a component of the bullnose assembly. More particularly, in some embodiments the deflector assemblies have upper and lower deflectors that include components that may be separated by a distance or may have channels or conduits of predetermined sizes. Depending on its size, the bullnose assembly may interact with the upper and lower deflectors and be deflected into a lateral wellbore or remain within the main wellbore and continue downhole. In addition, the deflectors described herein may allow the bullnose assembly to be properly deflected regardless of the orientation of the deflectors relative to the direction of gravitational forces. The disclosed embodiments may prove advantageous for well operators in being able to accurately access particular lateral wellbores by running downhole bullnose assemblies of known parameters.

Figure 1B:
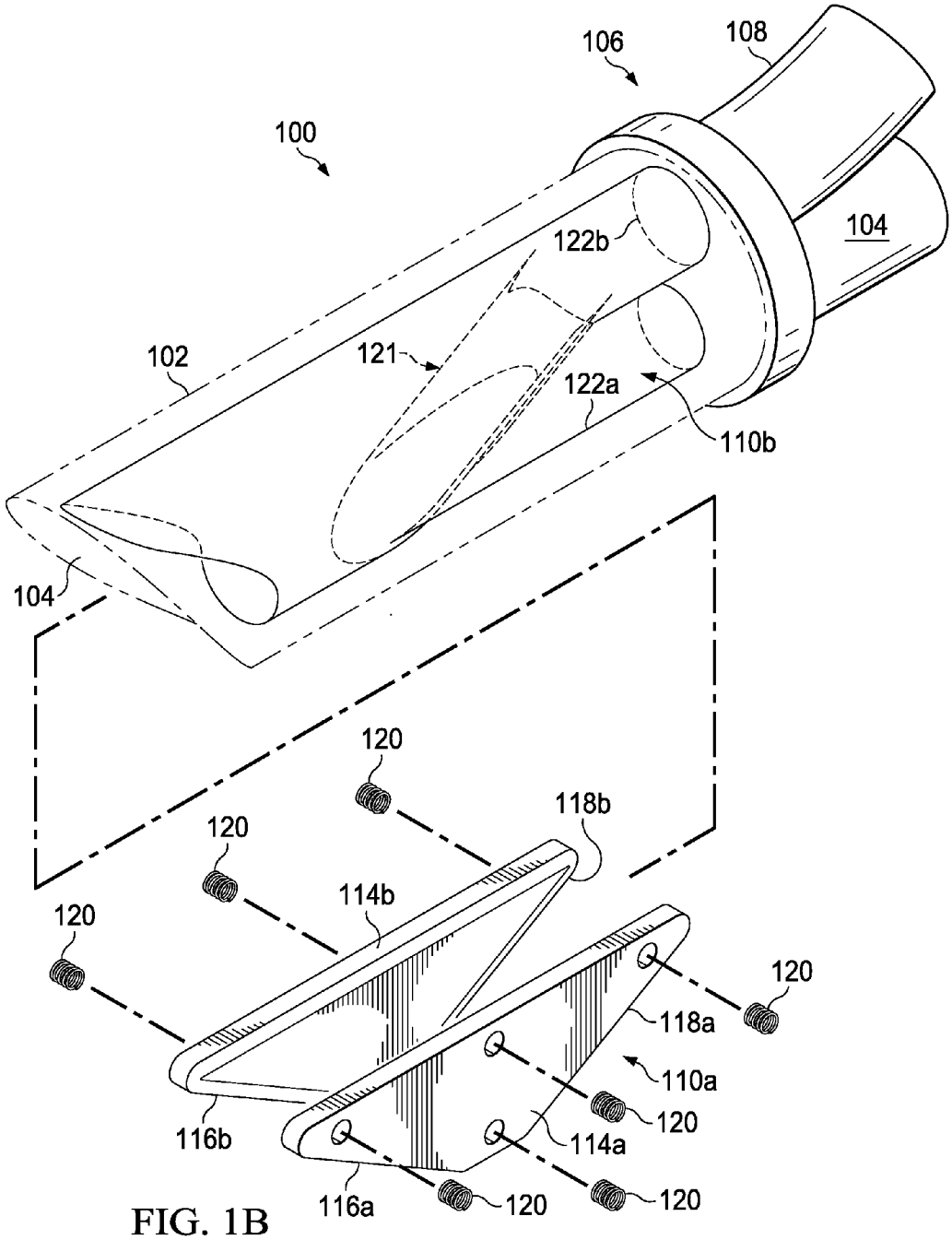

Referring to FIGS. 1A, 1B, and 2, illustrated are isometric, isometric exploded, and cross-sectional side views, respectively, of an exemplary deflector assembly 100, according to one or more embodiments of the disclosure. As illustrated, the deflector assembly 100 may be arranged within or otherwise form an integral part of a tubular string 102. In some embodiments, the tubular string 102 may be a casing string used to line the inner wall of a wellbore drilled into a subterranean formation. In other embodiments, the tubular string 102 may be a work string extended downhole within the wellbore or the casing that lines the wellbore. In either case, the deflector assembly 100 may be generally arranged within a parent or main bore 104 at or otherwise uphole from a junction 106 where a lateral bore 108 extends from the main bore 104. The lateral bore 108 may extend into a lateral wellbore (not shown) drilled at an angle away from the parent or main bore 104.

The deflector assembly 100 may include a first or upper deflector 110*a* and a second or lower deflector 110*b*. In some embodiments, the upper and lower deflectors 110*a,b* may be secured within the tubular string 102 using one or more mechanical fasteners (not shown) and the like. In other embodiments, the upper and lower deflectors 110*a,b* may be welded into place within the tubular string 102, without departing from the scope of the disclosure. In yet other embodiments, the upper and lower deflectors 110*a,b* may form an integral part of the tubular string 102, such as being machined out of bar stock and threaded into the tubular string 102. The upper deflector 110*a* may be arranged closer to the surface (not shown) than the lower deflector 110*b*, and the lower deflector 110*b* may be generally arranged at or adjacent the junction 106.

The upper deflector 110*a* may include a first plate 114*a* and a second plate 114*b* positioned substantially longitudinally relative to the tubular string 102 and spaced apart a distance 115. The distance 115 may be a predetermined distance, and the first and second plates 114*a,b* may be substantially parallel such that the spacing between the plates is relatively constant. Alternatively, the distance 115 may be indicative of the spacing between the first and second plates 114*a,b* on an upper or uphole end 117 of the plates, while the space between the plates in other areas is greater or less than the distance 115. In another embodiment, the upper deflector 110*a* may include a single plate, which is spaced by the distance 115 from a secondary member. The secondary member may be a non-movable or movable structure that is integral to or otherwise associated with the tubular string 102. For example, the secondary member may be a portion of the tubular string 102 from which the plate is spaced. In another embodiment, the secondary member may be an additional plate.

As depicted, the first and second plates 114*a,b* are substantially triangular or trapezoidal in shape and substantially planar. The first and second plates 114*a,b* may each include an upper ramped surface 116*a,b* and a lower ramped surface 118*a,b*. In some embodiments, it may be desirable for one or both of the first and second plates 114*a,b* to not include the lower ramped surfaces 118*a,b*. In some embodiments, only one of the first and second plates 114*a,b* may include one of the upper ramped surfaces 116*a,b*. While the upper and lower ramped surfaces 116*a,b*, 118*a,b* are depicted as being substantially planar, it may desirable for upper and lower ramped surfaces 116*a,b*, 118*a,b* to be non-planar in some embodiments. Similarly, while the first and second plates 114*a,b* are substantially triangular or trapezoidal in shape and substantially planar, the first and second plates 114*a,b* may instead comprise other non-triangular or non-trapezoidal shapes and may be non-planar. Edges of the ramped surfaces 116*a,b* and the lower ramped surfaces 118*a,b* may be chamfered or rounded as depicted to more smoothly deflect a bullnose assembly as described herein. Other ramped surfaces may be rounded tapered surfaces, rounded tapered helical surfaces, or others.

Each of the first and second plates 114*a,b* may be received within the tubular string 102 or within a recess of the tubular string 102. As depicted, the first and second plates 114*a,b* are longitudinally centered about a centerline axis of the tubular string 102. A plurality of biasing members 120 may be positioned between each of the first and second plates 114*a,b* and the tubular string 102 to bias the first and second plates 114*a,b* toward one another. In some embodiments, the biasing member 120 may be compression coil springs. Alternatively, the biasing members 120 may be tension coil springs that are positioned between the first and second plates 114*a,b*. In other embodiments, the biasing members 120 may be other types of springs or devices that assist in urging the first and second plates 114*a,b* toward one another to maintain the distance 115. Various types of biasing members 120 may be combined to cooperatively urge the first and second plates 114*a,b* toward one another. While it is depicted in FIGS. 1A and 1B that multiple biasing members 120 are present, a single biasing member 120 may be used with each of the first and second plates 114*a,b*. Alternatively, multiple biasing members 120 may be associated with each of the first and second plates 114*a,b*, and the positioning and spacing of the biasing members 120 may vary. As depicted, the biasing members 114*a,b* are spaced approximately equally around a perimeter of the first and second plates 114*a,b*. In some embodiments, one or more biasing members 120 may be positioned only in certain areas of the first and second plates 114*a,b*. For example, it may be desired to position only one or a few biasing members 120 toward the upper end 117 of the first and second plates 114*a,b* such that only these ends of the first and second plates 114*a,b* are biased toward one another to achieve the distance 115. In other embodiments, it may be desirable to associate the one or more biasing members 120 with only one of the first and second plates 114*a,b*. In such an embodiment, one of the first and second plates 114*a,b* may be secured substantially stationary within the tubular string 102 or be an integral feature thereof, and another of the first and second plates 114*a,b* may be movable and biased toward the other plate by the biasing member 120.

In the embodiments illustrated in FIGS. 1A, 1B, and 2, each of the first and second plates 114*a,b* is movable between a first position and a second position. While the plates 114*a,b* may be capable of some longitudinal movement within the tubular string 102, movement of the plates 114*a,b* primarily occurs in a direction perpendicular to a longitudinal axis of the tubular string 102 such that the movement tends to position the plates 114*a,b* closer together or further apart. In the first position, the first and second plates 114*a,b* are biased toward one another to achieve the distance 115 between at least some part of the plates. The second position of the first and second plates 114*a,b* is such that the plates 114*a,b* in this second position are spaced further apart from one another, i.e., a distance greater than the distance 115.

While the upper deflector 110*a* has been described as including one or more plates, the upper deflector 110*a* may instead include alternative structures that are not necessarily plate-like. For example, one or more spherically-shaped or other rounded members may be used instead of the one or more plates. These members may also be spaced by a distance that is may be variable. These members may also be biased toward one another to minimize the distance between the members in a first position.

The lower deflector 110*b* may define a ramped surface 121 (removed for clarity in FIG. 1A but illustrated in FIG. 1B), a first conduit 122*a* and a second conduit 122*b*, where both the first and second conduits 122*a,b* extend longitudinally through the lower deflector 110*b*. When the lower deflector 110*b* is arranged within the tubular string 102, an end of the ramped surface 121 begins beneath the first and second plates 114*a,b* and extends in an inclined fashion toward the first conduit 122*a* and the second conduit 122*b*. The second conduit 122*b* extends into and fluidly communicates with the lateral bore 108 while the first conduit 122*a* extends downhole and fluidly communicates with a lower or downhole portion of the parent or main bore 104 past the junction 106. Accordingly, in at least one embodiment, the deflector assembly 100 may be arranged in a multilateral wellbore system where the lateral bore 108 is only one of several lateral bores that are accessible from the main bore 104 via a corresponding number of deflector assemblies 100 arranged at multiple junctions.

The deflector assembly 100 may be useful in directing a bullnose assembly (not shown) into the lateral bore 108 via the second conduit 122*b* based on a width (e.g., diameter) of the bullnose assembly. If the width of the bullnose assembly does not meet particular width requirements or other parameters (such as geometrical requirements), it will instead be directed further downhole in the main bore 104 via the first conduit 122*a* as described in more detail below.

Referring now to FIGS. 3A and 3B, with continued reference to FIGS. 1A, 1B, and 2, illustrated are end views of the deflector assembly 100, according to one or more embodiments. In FIG. 3A, the first conduit 122*a* and the second conduit 122*b* are illustrated extending through the lower deflector 110*b*. While shown in FIG. 3A as being separate from each other, in some embodiments the conduits 122*a,b* may overlap with each other a short distance, without departing from the scope of the disclosure. The first conduit 122*a* may exhibit a first width 302*a* and the second conduit 122*b* may exhibit a second width 302*b*.

As depicted, the first width 302*a* is less than the second width 302*b*. As a result, bullnose assemblies exhibiting a diameter larger than the first width 302*a* but smaller than the second width 302*b* may be prevented from entering the first conduit 122*a* and deflected by the ramped surface 121 toward the second conduit 122*b*. Since the bullnose assembly includes a diameter smaller than the second width 302*b*, the bullnose assembly is permitted to enter the lateral bore 108 via the second conduit 122*b*. Alternatively, bullnose assemblies exhibiting a diameter smaller than the first width 302*a* may be able to pass into a lower portion of the main bore 104 through the first conduit 122*a*. The lower deflector 110*b* may be oriented such that the bullnose assembly, under the influence of gravity, is introduced to the ramped surface 121 nearest the first conduit 122*a*. This allows the lower deflector 110*b* to properly determine how the bullnose assembly will be directed. In other words, bullnose assemblies having widths smaller than the first conduit 122*a* will pass into the first conduit 122*a*. Bullnose assemblies having widths larger than the first conduit 122*a* will be deflected into the second conduit 122*b*. If the bullnose assembly were first introduced to the ramped surface 112 nearest the second conduit 122*b*, the bullnose assembly would pass into the second conduit 122*b*, even if the bullnose assembly were smaller than the first conduit 122*a*. In short, if the lower deflector 110*b* is used alone without the upper deflector 110*a*, the orientation of the lower deflector 110*b* within the tubular string 102 and the influence of gravitational forces may play a large role in determining whether the bullnose assembly is properly introduced to the lower deflector 110*b*.

In FIG. 3B, the first and second plates 114*a,b* of the upper deflector 110*a* are shown in relation to first and second conduits 122*a,b*. As previously described, the first and second plates 114*a,b* in the first position (illustrated in FIG. 3B) are separated by the distance 115. The distance 115 as depicted is smaller than the first width 302*a* and the second width 302*b*. In such an embodiment, when the first and second plates 114*a,b* are in the first position, a bullnose assembly having a width small enough to pass into the first conduit 122*a* as described may still be too large to pass between the first and second plates 114*a,b*.

The first and second plates 114*a,b* are provided to properly position the bullnose assembly as the bullnose assembly advances toward the lower deflector 110*b*. The plates 114*a,b* assist in eliminating the requirement that the direction of gravitational forces be coordinated with orientation of the lower deflector 110*b* in the tubular string 102. More specifically, as depicted, the upper ramped surfaces 116*a,b* of the first and second plates 114*a,b* may assist in deflecting the bullnose assembly such that the bullnose assembly may be aligned with the first conduit 122*a* of the lower deflector 110*b*.

Figure 4A:
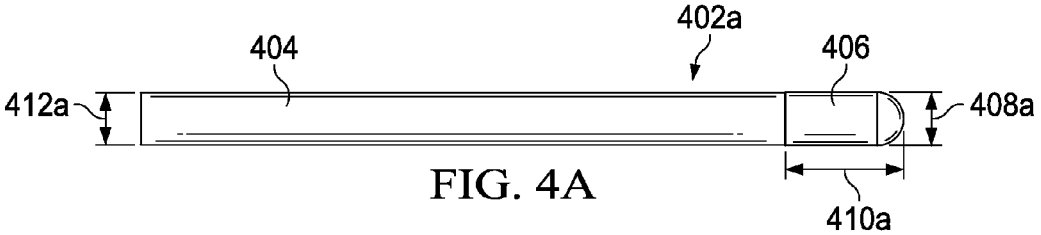
FIGS. 4A and 4B depict exemplary first and second bullnose assemblies, respectively, according to one or more embodiments.
Figure 4B:
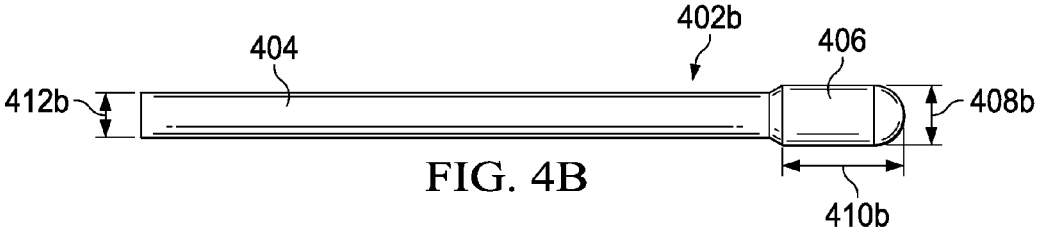

Referring now to FIGS. 4A and 4B, illustrated are exemplary first and second bullnose assemblies 402*a* and 402*b*, respectively, according to one or more embodiments. The bullnose assemblies 402*a,b* may constitute the distal end of a tool string (not shown), such as a bottom hole assembly or the like, that is conveyed downhole within the main wellbore 104 (FIGS. 1A, 1B, and 2). In some embodiments, the bullnose assemblies 402*a,b* and related tool strings are conveyed downhole using coiled tubing (not shown). In other embodiments, the bullnose assemblies 402*a,b* and related tool strings may be conveyed downhole using other types of conveyances such as, but not limited to, drill pipe, production tubulars, wireline, slickline, electric line, etc. The tool string may include various downhole tools and devices configured to perform or otherwise undertake various wellbore operations once accurately placed in the downhole environment. The bullnose assemblies 402*a,b* may be configured to accurately guide the tool string downhole such that it reaches its target destination, e.g., the lateral bore 108 or further downhole within the main bore 104.

To accomplish this, each bullnose assembly 402*a,b* may include a body 404 and a bullnose tip 406 coupled or otherwise attached to the distal end of the body 404. In some embodiments, the bullnose tip 406 may form an integral part of the body 404 as an integral extension thereof. As illustrated, the bullnose tip 406 may be rounded off at its end or otherwise angled or arcuate such that the bullnose tip 406 does not present sharp corners or angled edges that might catch on portions of the main bore 104 as it is extended downhole.

The bullnose tip 406 of the first bullnose assembly 402*a* exhibits a first width 408*a* and the bullnose tip 406 of the second bullnose assembly 402*b* exhibits a second width 408*b*. As depicted, the first width 408*a* is less than the second width 408*b*. In some embodiments, the cross-sectional shapes of the bullnose tips 406 are circular and thus the widths 408*a,b* may be diameters. The first width 408*a* may be smaller than the first width 302*a* of the first conduit 122*a*, and the second width 408*b* may be larger than the first width 302*a* but smaller than the second width 302*b* of the second conduit 122*b*. The bullnose tip 406 of the first bullnose assembly 402*a* exhibits a first length 410*a* and the bullnose tip 406 of the second bullnose assembly 402*b* exhibits a second length 410*b*. In some embodiments, the first and second lengths 410*a,b* may be the same or substantially the same. In other embodiments, the first and second lengths 410*a,b* may be different.

Still referring to FIGS. 4A and 4B, the body 404 of the first bullnose assembly 402*a* exhibits a third diameter 412*a* and the body 404 of the second bullnose assembly 402*b* exhibits a fourth diameter 412*b*. In some embodiments, the third and fourth diameters 412*a,b* may be the same or substantially the same. In other embodiments, the third and fourth diameters 412*a,b* may be different. In either case, the third and fourth diameters 412*a,b* may be smaller than the first and second widths 408*a,b*. Moreover, the third and fourth diameters 412*a,b* may be smaller than the first width 302*a* and second width 302*b*, respectively, of the first and second conduits 122*a,b* and otherwise able to be received therein, as will be discussed in greater detail below.

Figure 5A:
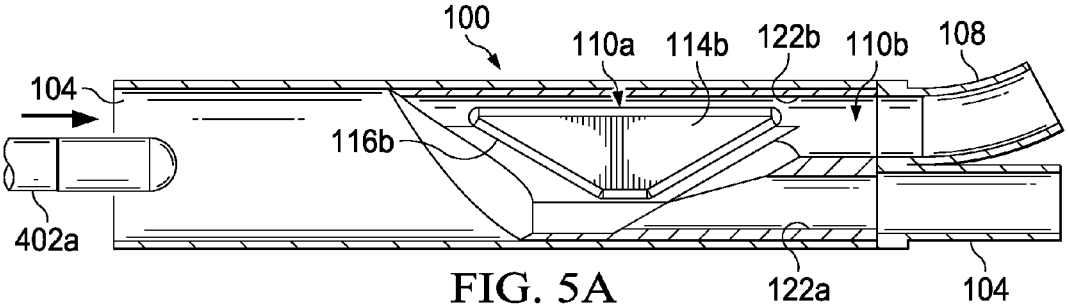
FIGS. 5A-5C illustrate cross-sectional progressive views of the deflector assembly of FIGS. 1 and 2 in exemplary operation with the bullnose assembly of FIG. 4A, according to one or more embodiments.
Figure 5B:
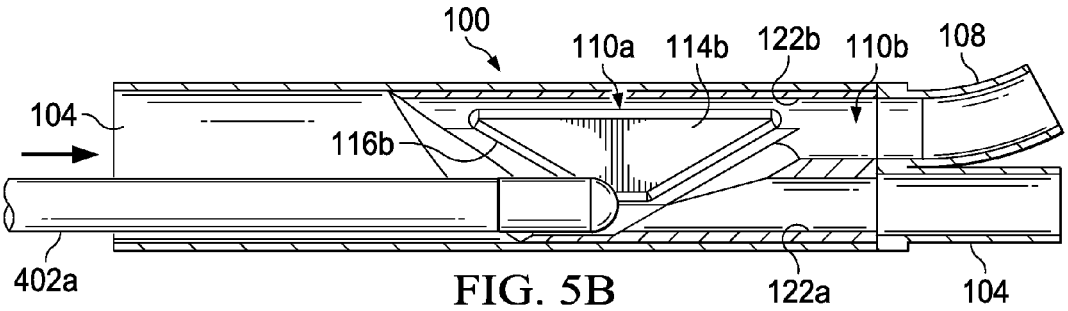
Figure 5C:
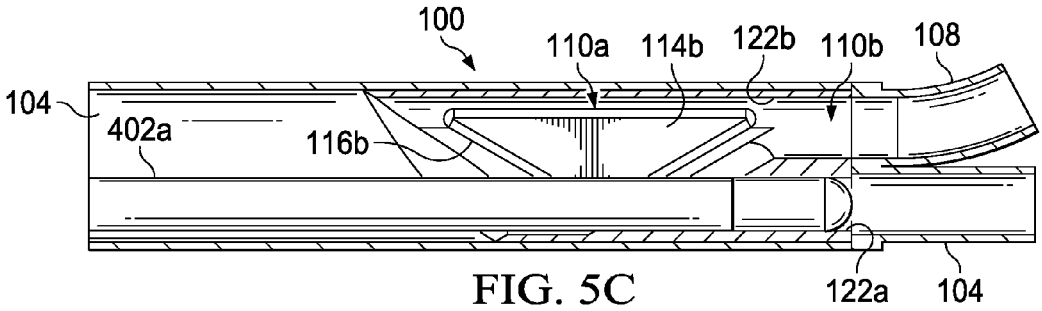

Referring now to FIGS. 5A-5C, with continued reference to the preceding figures, illustrated are cross-sectional views of the deflector assembly 100 as used in exemplary operation, according to one or more embodiments. More particularly, FIGS. 5A-5C illustrate progressive views of the first bullnose assembly 402*a* of FIG. 4A interacting with and otherwise being deflected by the deflector assembly 100 based on the parameters of the first bullnose assembly 402*a*.

In FIGS. 5A and 5B, the first bullnose assembly 402*a* is extended downhole within the main bore 104 and engages the upper deflector 110*a*. More specifically, the bullnose tip 406 slidingly engages the upper ramped surfaces 116*a,b* of the first and second plates 114*a,b*, which urge the bullnose assembly 402*a* into alignment with the first conduit 122*a* of the lower deflector 110*b* (see FIG. 5B). The proximity of the plates 114*a,b* to one another (separated by distance 115) prevents the bullnose assembly 402*a* from passing between the plates 114*a,b*. The bullnose assembly 402*a* is therefore deflected by the upper ramped surfaces 116*a,b* toward a wall of the tubular string 102.

In FIG. 5C, the bullnose assembly 402*a* continues to advance, and since the first width 408*a* of the bullnose tip 406 is less than the first width 302*a* of the first conduit 122*a*, the bullnose assembly 402*a* is received by the first conduit 122*a* and continues into the lower portion of the main bore 104.

Referring now to FIGS. 6A-6D, with continued reference to the preceding figures, illustrated are cross-sectional views of the deflector assembly 100 as used in exemplary operation, according to one or more embodiments. More particularly, FIGS. 6A-6D illustrate progressive views of the second bullnose assembly 402*b* interacting with and otherwise being deflected by the deflector assembly 100.

Figure 6A:
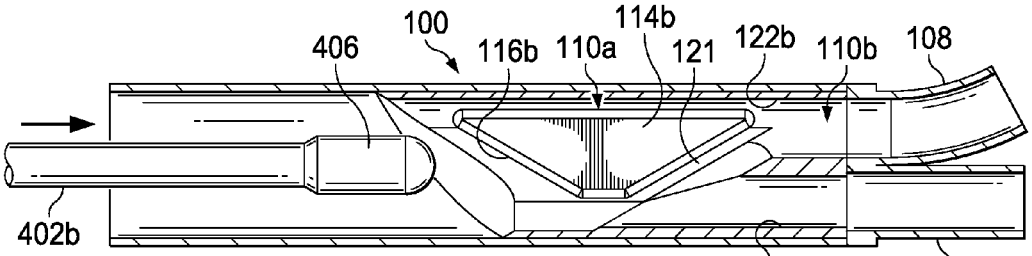
FIGS. 6A-6D illustrate cross-sectional progressive views of the deflector assembly of FIGS. 1 and 2 in exemplary operation with the bullnose assembly of FIG. 4B, according to one or more embodiments.
Figure 6B:
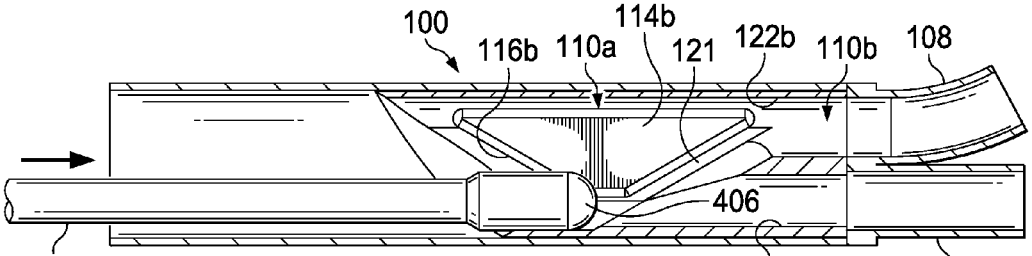

In FIGS. 6A and 6B, the second bullnose assembly 402*b* is shown engaging the upper deflector 110*a* after having been extended downhole within the main bore 104. More specifically, and similar to the first bullnose assembly 402*a*, the width 408*b* (FIG. 4B) of the bullnose tip 406 may be larger than the distance 115 between first and second plates 114*a,b*. As the bullnose tip 406 engages the upper ramped surfaces 116*a,b*, the second bullnose assembly 402*b* is initially urged toward the wall of the tubular string 102 such that the second bullnose assembly 402*b* is approximately aligned with first conduit 122*a*.

Figure 6C:
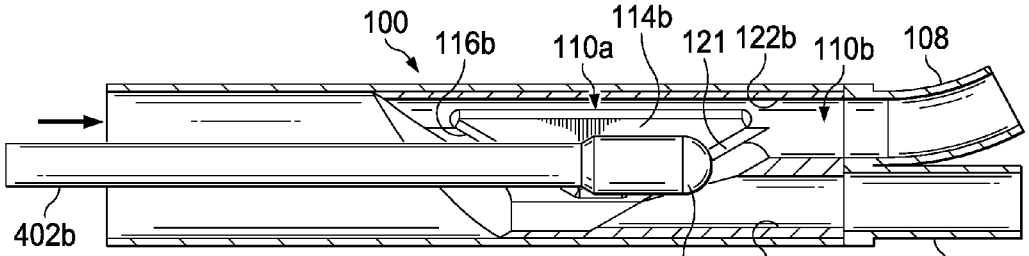
Figure 6D:
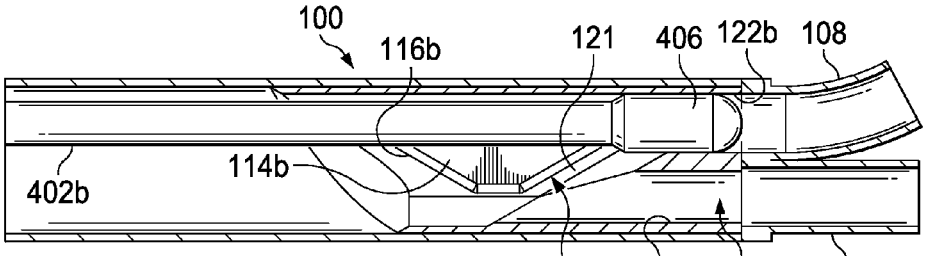

In FIGS. 6C and 6D, as the second bullnose assembly 402*b* advances and approaches lower deflector 110*b*, the second width 408*b* of the bullnose tip 406, which is greater than the first width 302*a* of the first conduit 122*a*, prevents the bullnose assembly 402*b* from entering the first conduit 122*a*. Instead, the bullnose tip 406 slidingly engages ramped surface 121 of lower deflector 110 and is urged toward second conduit 122*b* and urges apart the first and second plates 114*a,b*. Since the second width 408*b* is less than the second width 302*b* of the second conduit 122*b*, the second bullnose assembly 402*b* is capable of entering and does enter the second conduit 122*b* (FIG. 6D), and then continues into lateral bore 108.

Accordingly, which bore (e.g., the main bore 104 or the lateral bore 108) a bullnose assembly enters is primarily determined by the relationship between the width 408*a*, 408*b* of the bullnose tip 406 and the widths 302*a,b* of the first and second conduits 122*a,b*. The presence of the upper deflector 110*a* assists in urging the bullnose assembly 402*a,b* into the proper position for approaching the lower deflector 110*b* without requiring the lower deflector to be positioned in a particular orientation relative to the direction of gravitational forces.

Figure 7:
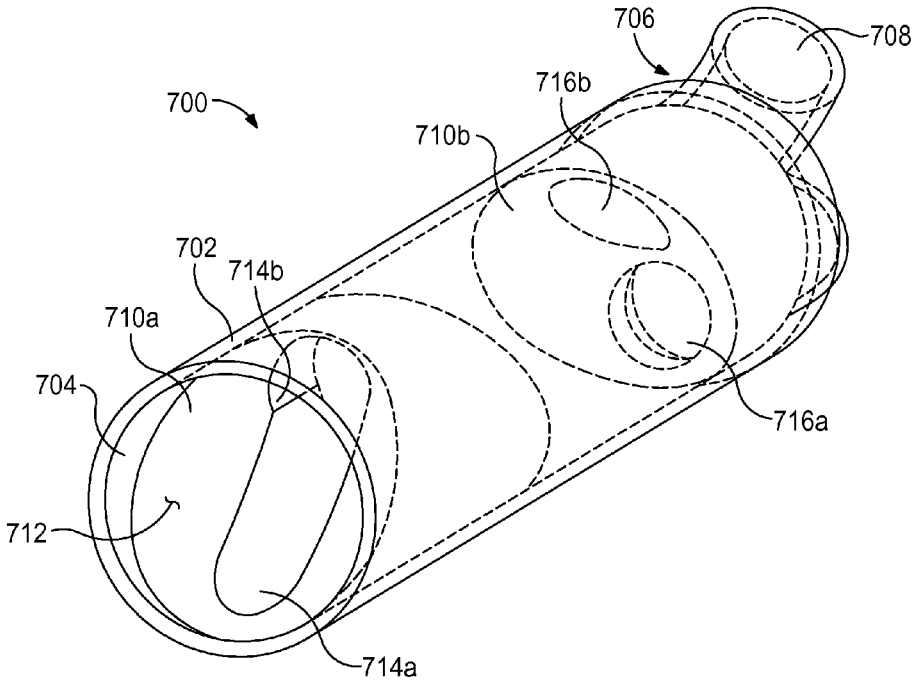
FIG. 7 depicts an isometric view of a deflector assembly, according to one or more embodiments of the disclosure.
Figure 8:
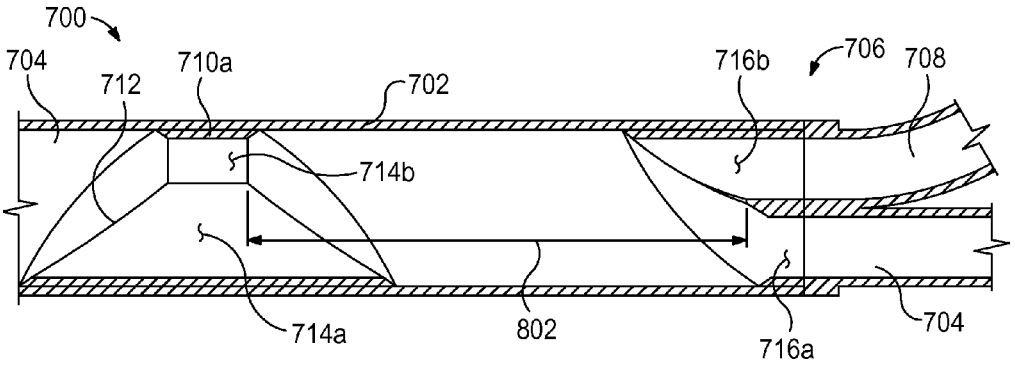
FIG. 8 depicts a cross-sectional side view of the deflector assembly of FIG. 7.

Referring to FIGS. 7 and 8, illustrated are isometric and cross-sectional side views, respectively, of an exemplary deflector assembly 700, according to one or more embodiments of the disclosure. As illustrated, the deflector assembly 700 may be arranged within or otherwise form an integral part of a tubular string 702. In some embodiments, the tubular string 702 may be a casing string used to line the inner wall of a wellbore drilled into a subterranean formation. In other embodiments, the tubular string 702 may be a work string extended downhole within the wellbore or the casing that lines the wellbore. In either case, the deflector assembly 700 may be generally arranged within a parent or main bore 704 at or otherwise uphole from a junction 706 where a lateral bore 708 extends from the main bore 704. The lateral bore 708 may extend into a lateral wellbore (not shown) drilled at an angle away from the parent or main bore 704.

The deflector assembly 700 may include a first or upper deflector 710*a* and a second or lower deflector 710*b*. In some embodiments, the upper and lower deflectors 710*a,b* may be secured within the tubular string 702 using one or more mechanical fasteners (not shown) and the like. In other embodiments, the upper and lower deflectors 710*a,b* may be welded into place within the tubular string 702, without departing from the scope of the disclosure. In yet other embodiments, the upper and lower deflectors 710*a,b* may form an integral part of the tubular string 702, such as being machined out of bar stock and threaded into the tubular string 702. The upper deflector 710*a* may be arranged closer to the surface (not shown) than the lower deflector 710*b*, and the lower deflector 710*b* may be generally arranged at or adjacent the junction 706 (see FIG. 8).

The upper deflector 710*a* may define or otherwise provide a ramped surface 712 facing toward the uphole direction within the main bore 704. The upper deflector 710*a* may further define a first channel 714*a* and a second channel 714*b*, where both the first and second channels 714*a,b* extend longitudinally through the upper deflector 710*a*. The lower deflector 710*b* may define a first conduit 716*a* and a second conduit 716*b*, where both the first and second conduits 716*a,b* extend longitudinally through the lower deflector 710*b*. The second conduit 716*b* extends into and otherwise communicates with the lateral bore 708 while the first conduit 716*a* extends downhole and otherwise communicates with a lower or downhole portion of the parent or main bore 704 past the junction 706. Accordingly, in at least one embodiment, the deflector assembly 700 may be arranged in a multilateral wellbore system where the lateral bore 708 is only one of several lateral bores that are accessible from the main bore 704 via a corresponding number of deflector assemblies 700 arranged at multiple junctions.

The deflector assembly 700 may be useful in directing a bullnose assembly (not shown) into the lateral bore 708 via the second conduit 716*b* based on a length of the bullnose assembly. If the length of the bullnose assembly does not meet particular length requirements or parameters, it will instead be directed further downhole in the main bore 704 via the first conduit 716*a*. For example, with reference to FIG. 8, the upper deflector 710*a* may be separated from the lower deflector 710*b* within the main bore 704 by a distance 802. The distance 802 may be a predetermined distance that allows a bullnose assembly that is as long as or longer than the distance 802 to be directed into the lateral bore 708 via the second conduit 716*b*. If the length of the bullnose assembly is shorter than the distance 802, however, the bullnose assembly will remain in the main bore 704 and be directed further downhole via the first conduit 716*a*.

Figure 9A:
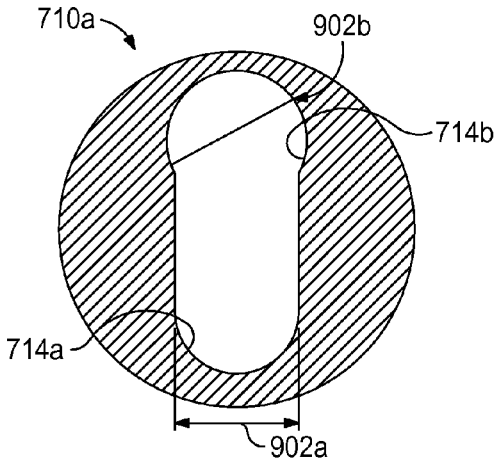
FIGS. 9A and 9B illustrate cross-sectional end views of upper and lower deflectors, respectively, of the deflector assembly of FIG. 7, according to one or more embodiments.
Figure 9B:
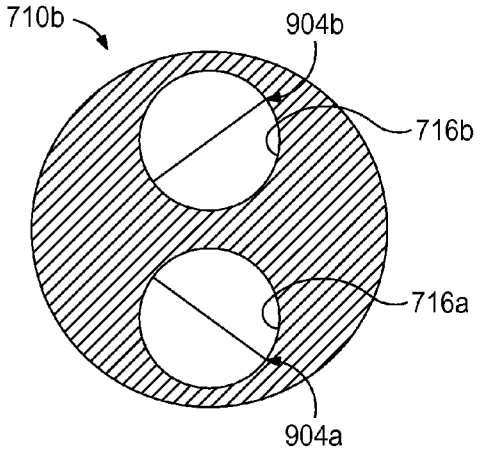

Referring now to FIGS. 9A and 9B, with continued reference to FIGS. 7 and 8, illustrated are cross-sectional end views of the upper and lower deflectors 710*a,b*, respectively, according to one or more embodiments. In FIG. 9A, the first channel 714*a* and the second channel 714*b* are shown as extending longitudinally through the upper deflector 710*a*. The first channel 714*a* may exhibit a first width 902*a* and the second channel 714*b* may exhibit a second width 902*b*, where the second width 902*b* is also equivalent to a diameter of the second channel 714*b*.

As depicted, the first width 902*a* is less than the second width 902*b*. As a result, bullnose assemblies exhibiting a diameter larger than the first width 902*a* but smaller than the second width 902*b* may be able to extend through the upper deflector 710*a* via the second channel 714*b* and otherwise bypass the first channel 714*a*. In such embodiments, the ramped surface 712 (FIGS. 7 and 8) may slidingly engage the bullnose assembly and otherwise direct it to the second channel 714*b*. Alternatively, bullnose assemblies exhibiting a diameter smaller than the first width 902*a* may be able to pass through the upper deflector 710*a* via the first channel 714*a*.

In FIG. 9B, the first and second conduits 716*a,b* are shown as extending longitudinally through the lower deflector 710*b*. While shown in FIG. 9B as being separate from each other, in some embodiments the conduits 716*a,b* may overlap with each other a short distance, without departing from the scope of the disclosure. The first conduit 716*a* may exhibit a first diameter 904*a* and the second conduit 716*b* may exhibit a second diameter 904*b*. In some embodiments, the first and second diameters 904*a,b* may be the same or substantially the same. In other embodiments, the first and second diameters 904*a,b* may be different. In either case, the first and second diameters 904*a,b* may be large enough and otherwise configured to receive a bullnose assembly therethrough after the bullnose assembly has passed through the upper deflector 710*a* (FIG. 9A).

Figure 10A:
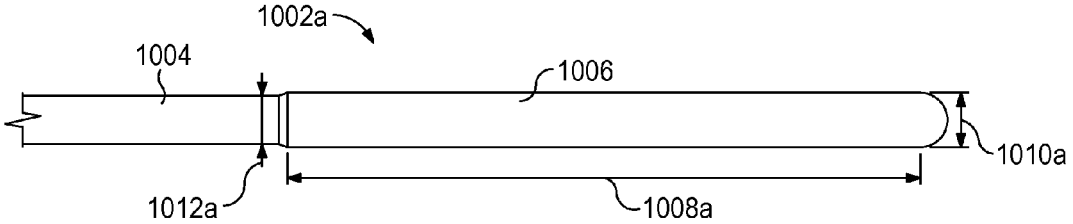
FIGS. 10A and 10B depict exemplary first and second bullnose assemblies, respectively, according to one or more embodiments.
Figure 10B:
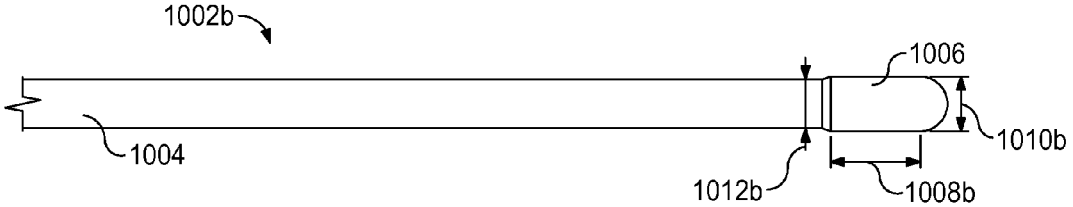

Referring now to FIGS. 10A and 10B, illustrated are exemplary first and second bullnose assemblies 1002*a* and 1002*b*, respectively, according to one or more embodiments. The bullnose assemblies 1002*a,b* may constitute the distal end of a tool string (not shown), such as a bottom hole assembly or the like, that is conveyed downhole within the main wellbore 704 (FIGS. 7-8). In some embodiments, the bullnose assemblies 1002*a,b* and related tool strings are conveyed downhole using coiled tubing (not shown). In other embodiments, the bullnose assemblies 1002*a,b* and related tool strings may be conveyed downhole using other types of conveyances such as, but not limited to, drill pipe, production tubulars, wireline, slickline, electric line, etc. The tool string may include various downhole tools and devices configured to perform or otherwise undertake various wellbore operations once accurately placed in the downhole environment. The bullnose assemblies 1002*a,b* may be configured to accurately guide the tool string downhole such that it reaches its target destination, e.g., the lateral bore 708 of FIGS. 7-8 or further downhole within the main bore 704.

To accomplish this, each bullnose assembly 1002*a,b* may include a body 1004 and a bullnose tip 1006 coupled or otherwise attached to the distal end of the body 1004. In some embodiments, the bullnose tip 1006 may form an integral part of the body 1004 as an integral extension thereof. As illustrated, the bullnose tip 1006 may be rounded off at its end or otherwise angled or arcuate such that the bullnose tip 1006 does not present sharp corners or angled edges that might catch on portions of the main bore 704 as it is extended downhole.

The bullnose tip 1006 of the first bullnose assembly 1002*a* exhibits a first length 1008*a* and the bullnose tip 1006 of the second bullnose assembly 1002*b* exhibits a second length 1008*b*. As depicted, the first length 1008*a* is greater than the second length 1008*b*. Moreover, the bullnose tip 1006 of the first bullnose assembly 1002*a* exhibits a first diameter 1010*a* and the bullnose tip 1006 of the second bullnose assembly 1002*b* exhibits a second diameter 1010*b*. In some embodiments, the first and second diameters 1010*a,b* may be the same or substantially the same. In other embodiments, the first and second diameters 1010*a,b* may be different. In either case, the first and second diameters 1010*a,b* may be small enough and otherwise able to extend through the second width 902*b* (FIG. 9A) of the upper deflector 710*a* and the first and second diameters 904*a,b* (FIG. 9B) of the lower deflector 710*b*.

Still referring to FIGS. 10A and 10B, the body 1004 of the first bullnose assembly 1002*a* exhibits a third diameter 1012*a* and the body 1004 of the second bullnose assembly 1002*b* exhibits a fourth diameter 1012*b*. In some embodiments, the third and fourth diameters 1012*a,b* may be the same or substantially the same. In other embodiments, the third and fourth diameters 1012*a,b* may be different. In either case, the third and fourth diameters 1012*a,b* may be smaller than the first and second diameters 1010*a,b*, or may be the same as diameters 1010*a,b*, respectively. Moreover, the third and fourth diameters 1012*a,b* may be smaller than the first width 902*a* (FIG. 9A) of the upper deflector 710*a* and otherwise able to be received therein, as will be discussed in greater detail below.

Figure 11A:
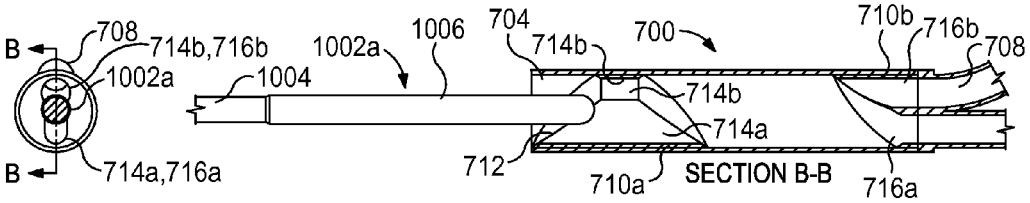
FIGS. 11A-11C illustrate cross-sectional progressive views of the deflector assembly of FIGS. 7 and 8 in exemplary operation with the bullnose assembly of FIG. 10A, according to one or more embodiments.
Figure 11B:
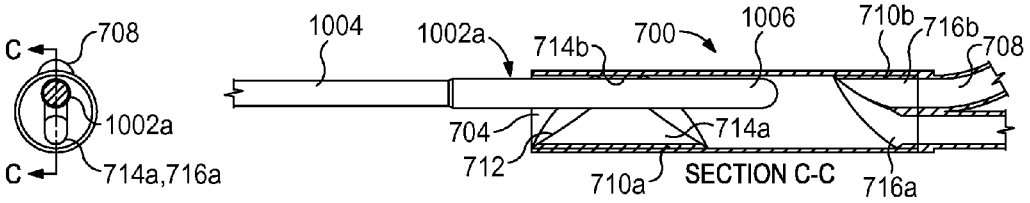
Figure 11C:
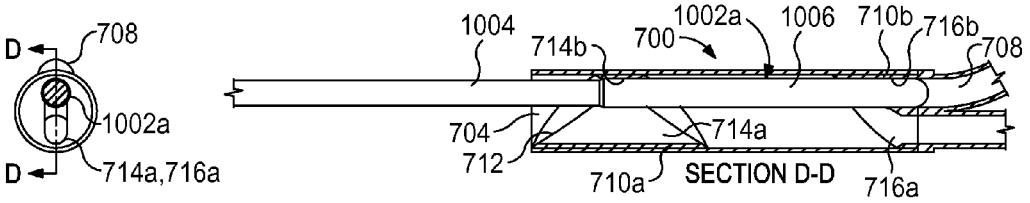

Referring now to FIGS. 11A-11C, with continued reference to the preceding figures, illustrated are cross-sectional views of the deflector assembly 700 as used in exemplary operation, according to one or more embodiments. More particularly, FIGS. 11A-11C illustrate progressive views of the first bullnose assembly 1002*a* of FIG. 10A interacting with and otherwise being deflected by the deflector assembly 700 based on the parameters of the first bullnose assembly 1002*a*. Furthermore, each of FIGS. 11A-11C provides a cross-sectional end view (on the left of each figure) and a corresponding cross-sectional side view (on the right of each figure) of the exemplary operation as it progresses.

In FIG. 11A, the first bullnose assembly 1002*a* is extended downhole within the main bore 704 and engages the upper deflector 710*a*. More specifically, the diameter 1010*a* (FIG. 10A) of the bullnose tip 1006 may be larger than the first width 902*a* (FIG. 9A) such that the bullnose tip 1006 is unable to extend through the upper deflector 710*a* via the first channel 714*a*. Instead, the bullnose tip 1006 may be configured to slidingly engage the ramped surface 712 until locating the second channel 714*b*. Since the diameter 1010*a* (FIG. 10A) of the bullnose tip 1006 is smaller than the second width 902*b* (FIG. 9A), the bullnose assembly 1002*a* is able to extend through the upper deflector 710*a* via the second channel 714*b*. This is shown in FIG. 11B as the bullnose assembly 1002*a* is advanced in the main bore 704 and otherwise extended at least partially through the upper deflector 710*a*.

In FIG. 11C, the bullnose assembly 1002*a* is advanced further in the main bore 704 and directed into the second conduit 716*b* of the lower deflector 710*b*. This is possible since the length 1008*a* (FIG. 10A) of the bullnose tip 1006 is greater than the distance 802 (FIG. 8) that separates the upper and lower deflectors 710*a,b*. In other words, since the distance 802 is less than the length 1008*a* of the bullnose tip 1006, the bullnose assembly 1002*a* is generally prevented from moving laterally within the main bore 704 and toward the first conduit 716*a* of the lower deflector 710*b*. Rather, the bullnose tip 1006 is received by the second conduit 716*b* while at least a portion of the bullnose tip 1006 remains supported in the second channel 714*b* of the upper deflector 710*a*. Moreover, the second conduit 716*b* exhibits a diameter 904*b* (FIG. 9B) that is greater than the diameter 1010*a* (FIG. 10A) of the bullnose tip 1006 and can therefore guide the bullnose assembly 1002*a* toward the lateral bore 708.

Referring now to FIGS. 12A-12D, with continued reference to the preceding figures, illustrated are cross-sectional views of the deflector assembly 700 as used in exemplary operation, according to one or more embodiments. More particularly, FIGS. 12A-12D illustrate progressive views of the second bullnose assembly 1002*b* interacting with and otherwise being deflected by the deflector assembly 700. Furthermore, similar to FIGS. 11A-11C, each of FIGS. 12A-12D provides a cross-sectional end view (on the left of each figure) and a corresponding cross-sectional side view (on the right of each figure) of the exemplary operation as it progresses.

Figure 12A:
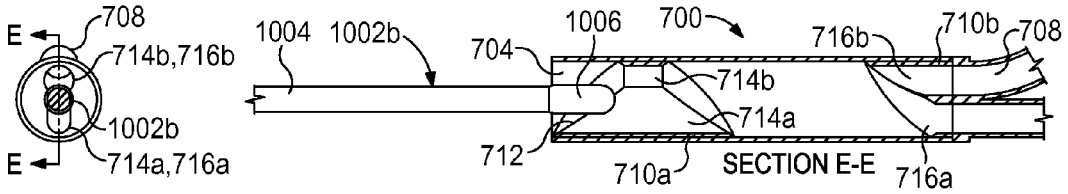
FIGS. 12A-12D illustrate cross-sectional progressive views of the deflector assembly of FIGS. 7 and 8 in exemplary operation with the bullnose assembly of FIG. 10B, according to one or more embodiments.
Figure 12B:
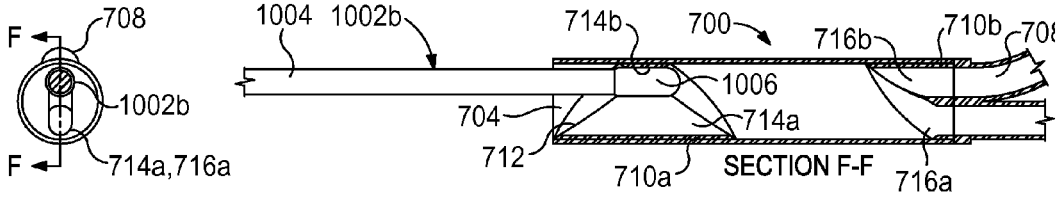

In FIG. 12A, the second bullnose assembly 1002*b* is shown engaging the upper deflector 710*a* after having been extended downhole within the main bore 704. More specifically, and similar to the first bullnose assembly 1002*a*, the diameter 1010*b* (FIG. 10B) of the bullnose tip 1006 may be larger than the first width 902*a* (FIG. 9A) such that the bullnose tip 1006 is unable to extend through the upper deflector 710*a* via the first channel 714*a*. Instead, the bullnose tip 1006 may be configured to slidingly engage the ramped surface 712 until locating the second channel 714*b*. Since the diameter 1010*b* (FIG. 10B) of the bullnose tip 1006 is smaller than the second width 902*b* (FIG. 9A), the bullnose assembly 1002*b* may be able to extend through the upper deflector 710*a* via the second channel 714*b*. This is shown in FIG. 12B as the bullnose assembly 1002*b* is advanced in the main bore 704 and otherwise extended at least partially through the upper deflector 710*a*.

Figure 12C:
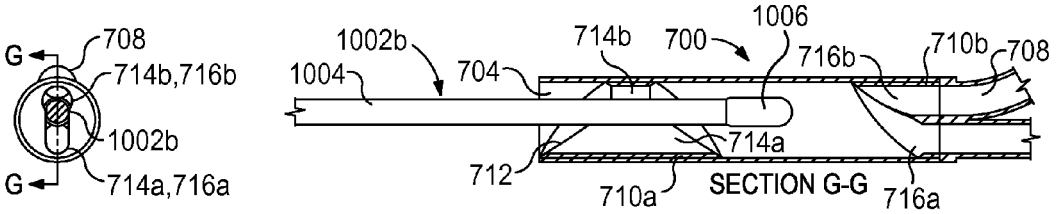

In FIG. 12C, the bullnose assembly 1002*b* is advanced further in the main bore 704 until the bullnose tip 1006 exits the second channel 714*b*. Upon the exit of the bullnose tip 1006 from the second channel 714*b*, the bullnose assembly 1002*b* may no longer be supported within the second channel 714*b* and may instead fall into or otherwise be received by the first channel 714*a*. This is possible since the diameter 1012*b* (FIG. 10B) of the body 1004 of the bullnose assembly 1002*b* is smaller than the first width 902*a* (FIG. 9A), and the length 1008*b* (FIG. 10B) of the bullnose tip 1006 is less than the distance 802 (FIG. 8) that separates the upper and lower deflectors 710*a,b*. Accordingly, gravity may act on the bullnose assembly 1002*b* and allow it to fall into the first channel 714*a* once the bullnose tip 1006 exits the second channel 714*b* and no longer supports the bullnose assembly 1002*b*.

Figure 12D:
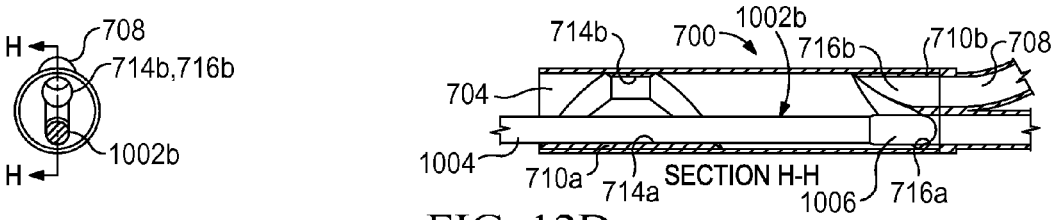

In FIG. 12D, the bullnose assembly 1002*b* is advanced even further in the main bore 704 until the bullnose tip 1006 enters or is otherwise received within the first conduit 716*a*. The first conduit 716*a* exhibits a diameter 904*a* (FIG. 9B) that is greater than the diameter 1010*b* (FIG. 10B) of the bullnose tip 1006 and can therefore guide the bullnose assembly 1002*b* further down the main bore 704 and otherwise not into the lateral bore 708.

Accordingly, which bore (e.g., the main bore 704 or the lateral bore 708) a bullnose assembly enters is primarily determined by the relationship between the length 1008*a*, 1008*b* of the bullnose tip 1006 and the distance 802 between the upper and lower deflectors 710*a,b*. As a result, it becomes possible to "stack" multiple junctions 706 (FIGS. 7 and 8) in one well and thereby facilitate re-entry into every lateral bore of the well by predetermining the spacing (i.e., distance 802) between the deflectors 710*a,b* at each junction 706 and selecting the appropriate bullnose assembly for the desired lateral bore.

Figure 13:
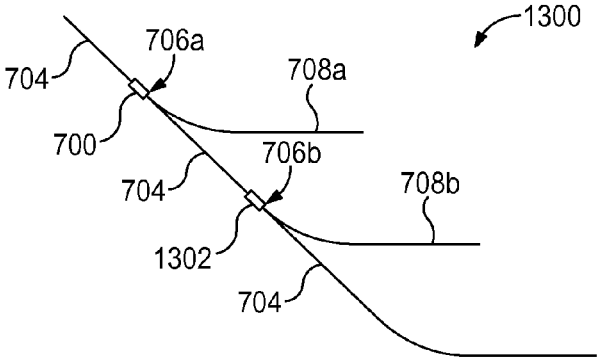
FIG. 13 illustrates an exemplary multilateral wellbore system that may implement the principles of the present disclosure.

Referring to FIG. 13, illustrated is an exemplary multilateral wellbore system 1300 that may implement the principles of the present disclosure. The wellbore system 1300 may include a main bore 704 that extends from a surface location (not shown) and passes through at least two junctions 706 (shown as a first junction 706*a* and a second junction 706*b*). While two junctions 706*a,b* are shown in the wellbore system 1300, it will be appreciated that more than two junctions 706*a,b* may be utilized, without departing from the scope of the disclosure. At each junction 706*a,b*, a lateral bore 708 (shown as first and second lateral bores 708*a* and 708*b*, respectively) extends from the main bore 704.

The deflector assembly 700 of FIGS. 7 and 8 may be arranged at the first junction 706*a* and a second deflector assembly 1302 may be arranged at the second junction 706*b*. Each deflector assembly 700, 1302 may be configured to deflect a bullnose assembly either into its corresponding lateral bore 708*a,b* or further downhole within the main bore 704, depending on the length of the bullnose tip of a particular bullnose assembly and the spacing between the upper and lower deflectors of the particular deflector assembly 700, 1302.

Figure 14:
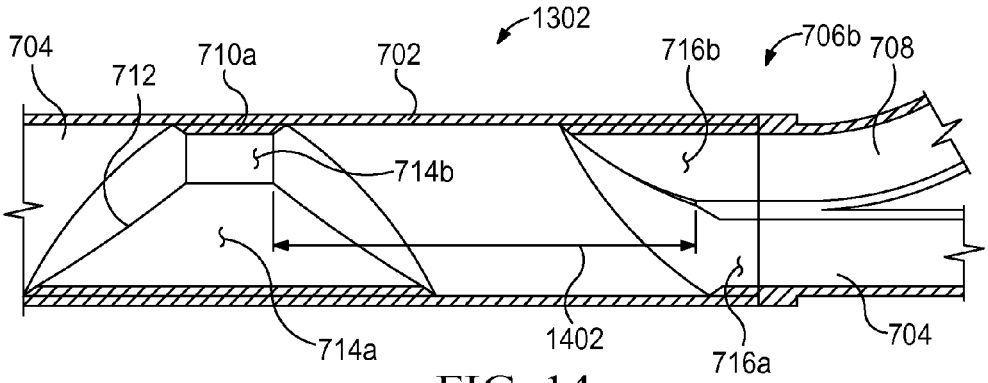
FIG. 14 illustrates a cross-sectional side view of another deflector assembly of FIG. 7, according to one or more embodiments.

Referring to FIG. 14, with continued reference to FIGS. 8 and 13, illustrated is a cross-sectional side view of the second deflector assembly 1302, according to one or more embodiments. The second deflector assembly 1302 may be similar in some respects to the deflector assembly 700 of FIGS. 7 and 8 (and now FIG. 13) and therefore may be best understood with reference thereto, where like numerals represent like elements not described again in detail. In the second deflector assembly 1302, the upper deflector 710*a* may be separated from the lower deflector 710*b* within the main bore 704 by a distance 1402. The distance 1402 may be less than the distance 802 in the first deflector assembly 700 of FIG. 8.

Accordingly, the first and second deflector assemblies 700, 1302 may be configured to deflect bullnose assemblies into different lateral bores 708*a,b* based on the length of the bullnose tip. If a bullnose tip is as long as or longer than the distances 802 and 1402, the corresponding bullnose assembly will be directed into the respective lateral bore 708*a,b*. If, however, the length of the bullnose tip is shorter than the distances 802 and 1402, the bullnose assembly will remain in the main bore 704 and be directed further downhole.

Figure 15:
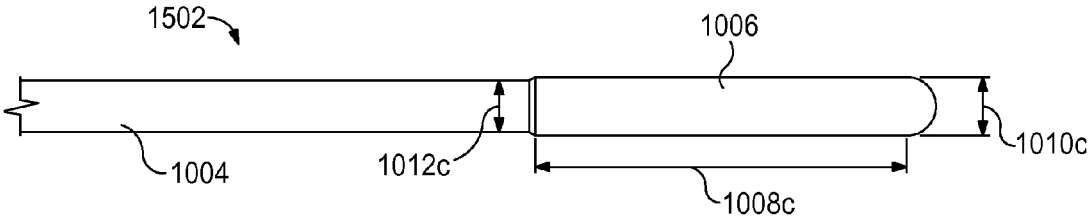
FIG. 15 illustrates another exemplary bullnose assembly, according to one or more embodiments.

Referring now to FIG. 15, with additional reference to FIGS. 10A and 10B, illustrated is another exemplary bullnose assembly 1502, according to one or more embodiments. The bullnose assembly 1502 may be substantially similar to the bullnose assemblies 1002*a,b* of FIGS. 10A and 10B and therefore may be best understood with reference thereto, where like numerals correspond to like elements not described again. Similar to the bullnose assemblies 1002*a,b*, of FIGS. 10A and 10B, the bullnose assembly 1502 may include a body 1004 and a bullnose tip 1006 coupled to or otherwise forming an integral part of the distal end of the body 1004.

The bullnose tip 1006 of the bullnose assembly 1502, however, exhibits a third length 1008*c* that is shorter than the first length 1008*a* (FIG. 10A) but longer than the second length 1008*b* (FIG. 10B). Moreover, the bullnose tip 1006 of the bullnose assembly 1502 exhibits a fifth diameter 1010*c* that may be the same as or different than the first and second diameters 1010*a,b* (FIGS. 10A and 10B). In any event, the fifth diameter 1010*c* may be small enough and otherwise able to extend through the second width 902*b* (FIG. 9A) of the upper deflector 710*a* and the first and second diameters 904*a,b* (FIG. 9B) of the lower deflector 710*b* of either the first or second deflector assemblies 700, 1302. Lastly, the body 1004 of the bullnose assembly 1502 exhibits a sixth diameter 1012*c* that may be the same as or different than the third and fourth diameters 1012*a,b* (FIGS. 10A and 10B). In any event, the sixth diameter 1012*c* may be smaller than the first, second, and third diameters 1010*a-c* and also smaller than the first width 902*a* (FIG. 9A) of the upper deflector 710*a* (of either the first or second deflector assemblies 700, 1302) and otherwise able to be received therein.

Referring now to FIGS. 16A-16D and FIGS. 17A-17C, with continued reference to the preceding figures, illustrated are cross-sectional views of the first deflector assembly 700 and the second deflector assembly 1302 as used in exemplary operation with the third bullnose assembly 1502, according to one or more embodiments. In at least one embodiment, FIGS. 16A-16D and 17A-17C may be representative progressive views of the third bullnose assembly 1502 traversing the multilateral wellbore system 1300 of FIG. 13. More particularly, FIGS. 16A-16D may depict the third bullnose assembly 1502 at the first junction 706*a* (FIG. 13) and FIGS. 17A-17C may depict the third bullnose assembly 1502 at the second junction 706*b* (FIG. 13).

Figure 16A:
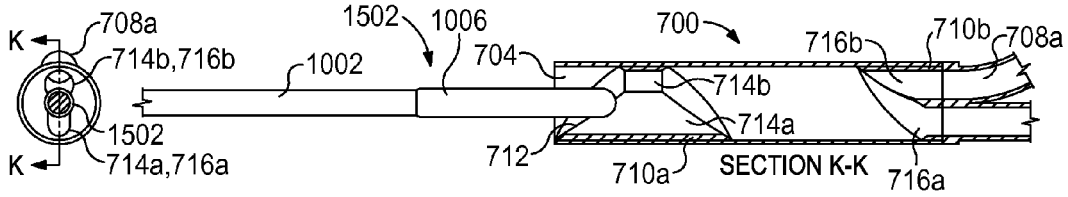
FIGS. 16A-16D illustrate cross-sectional progressive views of the deflector assembly of FIGS. 7 and 8 in exemplary operation with the bullnose assembly of FIG. 15, according to one or more embodiments.
Figure 16B:
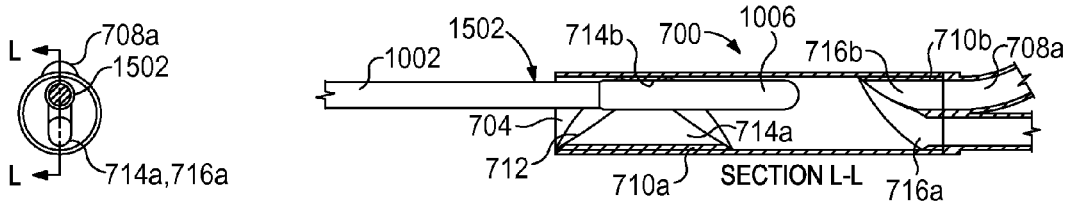

More particularly, FIGS. 16A-16D illustrate progressive views of the bullnose assembly 1502 interacting with and otherwise being deflected by the deflector assembly 700 based on the parameters of the bullnose assembly 1502. In FIG. 16A, the bullnose assembly 1502 is shown engaging the upper deflector 710*a* after having been extended downhole within the main bore 704. The diameter 1010*c* (FIG. 15) of the bullnose tip 1006 may be larger than the first width 902*a* (FIG. 9A) such that the bullnose tip 1006 is unable to extend through the upper deflector 710*a* via the first channel 714*a*. Instead, the bullnose tip 1006 may be configured to slidingly engage the ramped surface 712 until locating the second channel 714*b*. Since the diameter 1010*c* (FIG. 15) of the bullnose tip 1006 is smaller than the second width 902*b* (FIG. 9A), the bullnose assembly 1502 may be able to extend through the upper deflector 710*a* via the second channel 714*b*. This is shown in FIG. 16B as the bullnose assembly 1502 is advanced in the main bore 704 and otherwise extended at least partially through the upper deflector 710*a*.

Figure 16C:
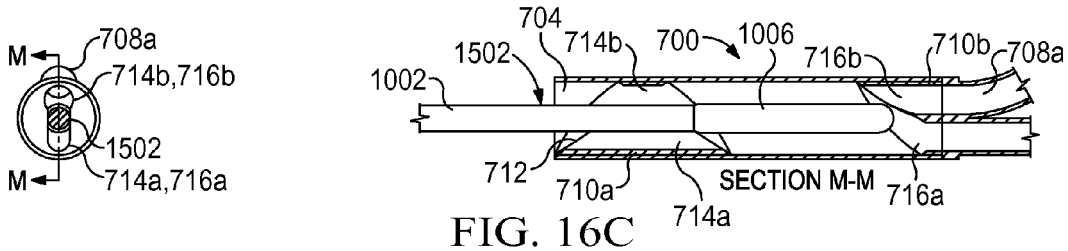

In FIG. 16C, the bullnose assembly 1502 is advanced further in the main bore 704 until the bullnose tip 1006 exits the second channel 714*b*. Upon the exit of the bullnose tip 1006 from the second channel 714*b*, the bullnose assembly 1502 may no longer be supported within the second channel 714*b* and may instead fall into or otherwise be received by the first channel 714*a*. This is possible since the diameter 1012*c* (FIG. 15) of the body 1004 of the bullnose assembly 1502 is smaller than the first width 902*a* (FIG. 9A), and the length 1008*c* (FIG. 15) of the bullnose tip 1006 is less than the distance 802 (FIG. 8) that separates the upper and lower deflectors 710*a,b*. Accordingly, gravity may act on the bullnose assembly 1502 and allow it to fall into the first channel 714*a* once the bullnose tip 1006 exits the second channel 714*b* and no longer supports the bullnose assembly 1502.

Figure 16D:
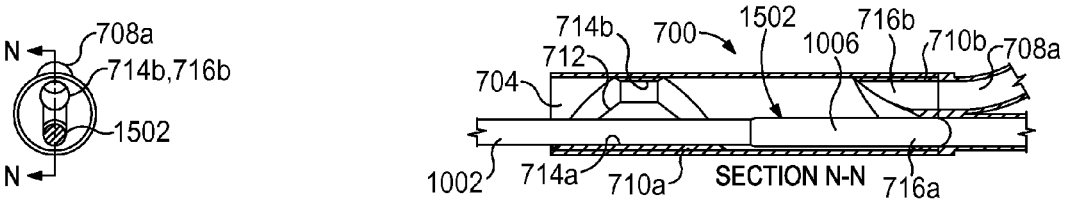

In FIG. 16D, the bullnose assembly 1502 is advanced even further in the main bore 704 until the bullnose tip 1006 enters or is otherwise received within the first conduit 716*a*. The first conduit 716*a* exhibits a diameter 904*a* (FIG. 9B) that is greater than the diameter 1010*c* (FIG. 15) of the bullnose tip 1006 and can therefore guide the bullnose assembly 1502 further down the main bore 704 and otherwise not into the first lateral bore 708*a*.

Figure 17A:
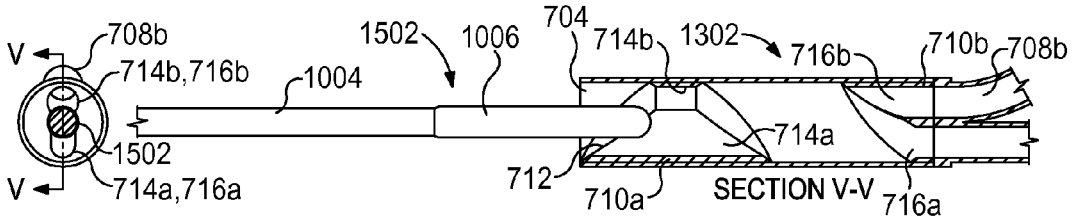
FIGS. 17A-17C illustrate cross-sectional views of the deflector assembly of FIG. 14 in exemplary operation with the bullnose assembly of FIG. 15, according to one or more embodiments.
Figure 17B:
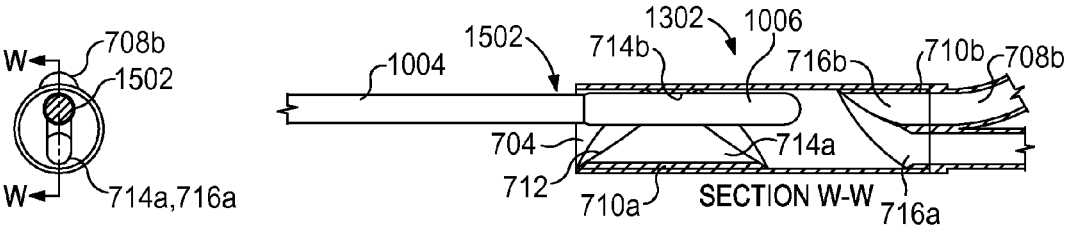
Figure 17C:
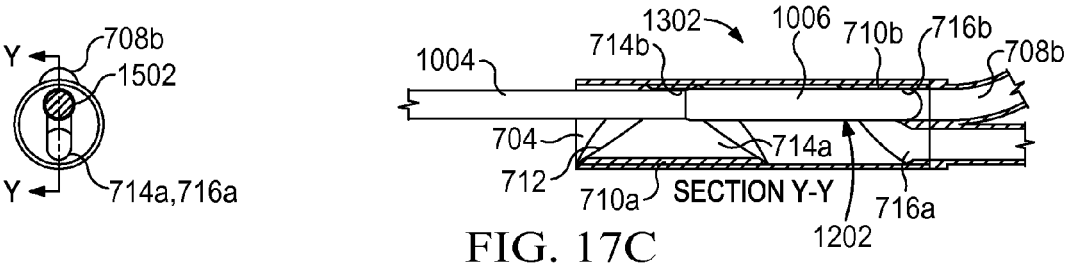
Figure 18A:
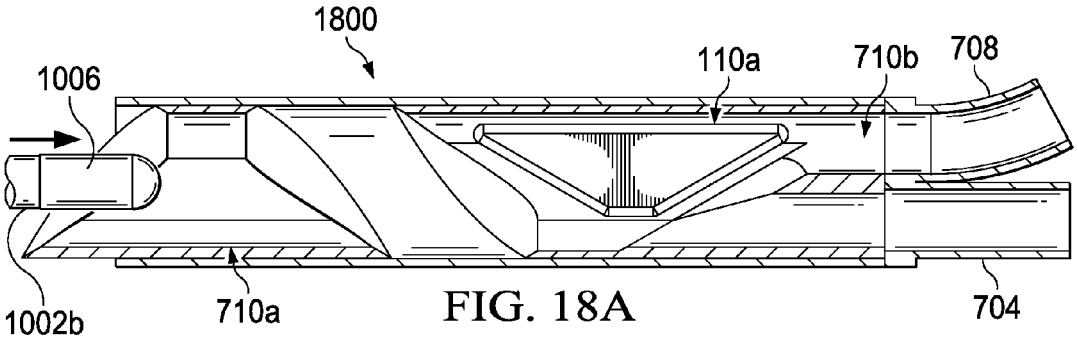
FIG. 18A-18D illustrate cross-sectional progressive views of an exemplary deflector assembly in operation with the bullnose assembly of FIG. 10B, according to one or more embodiments.
Figure 18B:
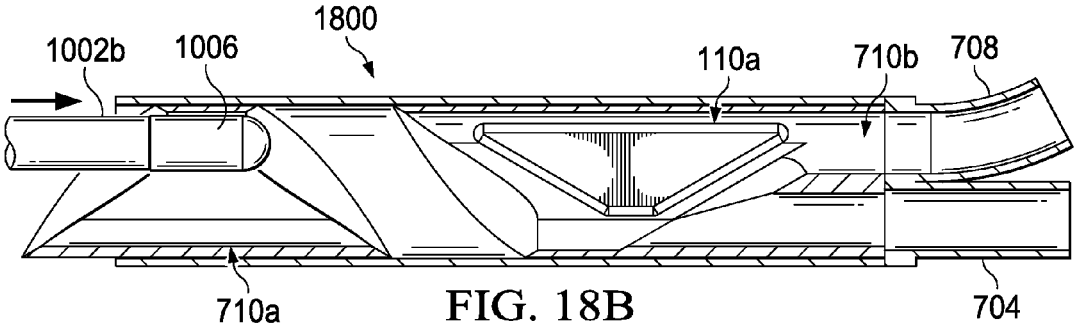
Figure 18C:
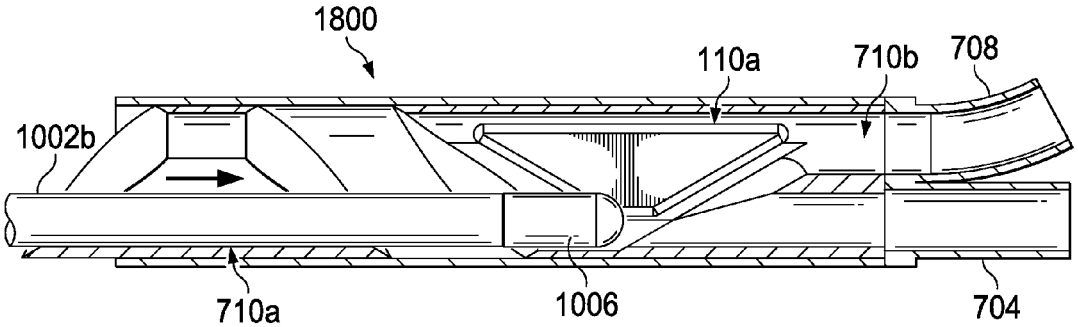
Figure 18D:
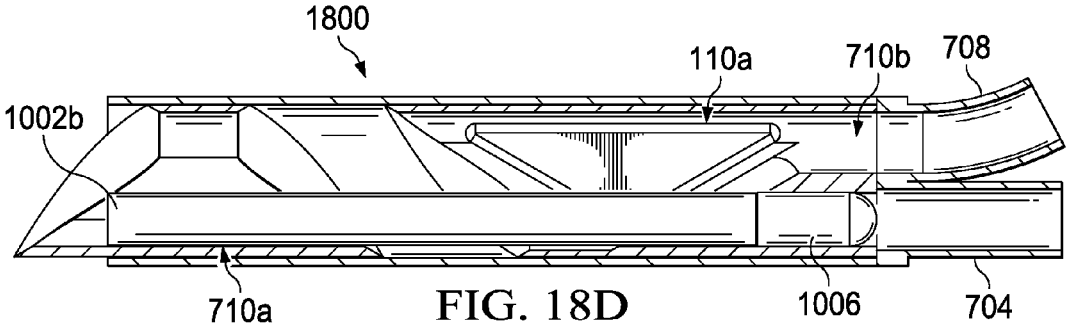

Referring now to FIGS. 17A-17C, with continued reference to FIGS. 16A-16D, illustrated are cross-sectional views of the second deflector assembly 1302 as used in exemplary operation with the third bullnose assembly 1502 following passage through the first deflector assembly 700. More particularly, FIGS. 17A-17C depict the third bullnose assembly 1502 after having passed through the first deflector assembly 700 in the multilateral wellbore system 1300 of FIG. 13 and is now advanced further within the main bore 704 until interacting with and otherwise being deflected by the second deflector assembly 1302.

In FIG. 17A, the third bullnose assembly 1502 is extended downhole within the main bore 704 and engages the upper deflector 710*a* of the second deflector assembly 1302. The diameter 1010*c* (FIG. 15) of the bullnose tip 1006 may be larger than the first width 902*a* (FIG. 9A) such that the bullnose tip 1006 is unable to extend through the upper deflector 710*a* via the first channel 714*a*. Instead, the bullnose tip 1006 may be configured to slidingly engage the ramped surface 712 until locating the second channel 714*b*. Since the diameter 1010*c* (FIG. 15) of the bullnose tip 1006 is smaller than the second width 902*b* (FIG. 9A), the bullnose assembly 1502 is able to extend through the upper deflector 710*a* via the second channel 714*b*. This is shown in FIG. 17B as the bullnose assembly 1502 is advanced in the main bore 704 and otherwise extended at least partially through the upper deflector 710*a*.

In FIG. 17C, the bullnose assembly 1502 is advanced further in the main bore 704 and directed into the second conduit 716*b* of the lower deflector 710*b*. This is possible since the length 1008*c* (FIG. 15) of the bullnose tip 1006 is greater than the distance 1402 (FIG. 13) that separates the upper and lower deflectors 710*a,b* of the second deflector assembly 1302. In other words, since the distance 1402 is less than the length 1008*c* of the bullnose tip 1006, the bullnose assembly 1502 is generally prevented from moving laterally within the main bore 704 and toward the first conduit 716*a* of the lower deflector 710*b*. Rather, the bullnose tip 1006 is received by the second conduit 716*b* while at least a portion of the bullnose tip 1006 remains supported in the second channel 714*b* of the upper deflector 710*a*. Moreover, the second conduit 716*b* exhibits a diameter 904*b* (FIG. 9B) that is greater than the diameter 1010*c* (FIG. 15) of the bullnose tip 1006 and can therefore guide the bullnose assembly 1502 toward the second lateral bore 708*b*.

Referring now to FIGS. 18A-18D, illustrated are cross-sectional views of a deflector assembly 1800 which includes the upper and lower deflector 710*a,b* illustrated in FIGS. 7 and 8, and the upper deflector 110*a* illustrated in FIG. 2. The structure and operation of the deflectors 710*a,b* and 110*a* are the same as that previously described with reference to the preceding figures. One difference between the embodiments previously described and the deflector assembly 1800 illustrated in FIGS. 18A-18D is the positioning of the upper deflector 110*a* between the upper deflector 710*a* and the lower deflector 710*b*. While the path (e.g., the main bore 704 or the lateral bore 708) the bullnose assembly enters is primarily determined by the relationship between the length of the bullnose tip 1006 and the distance between the upper and lower deflectors 710*a,b*, the presence of the upper deflector 110*a* assists in providing a biasing force to the bullnose assembly 1002*b* so that it is not necessary to rely upon gravitational forces to assist with the operation of upper deflector 710*a*. In FIGS. 18A-18D, the length of the bullnose tip 1006 results in the bullnose assembly 1002*b* being directed into the main bore 704. Upon the exit of the bullnose tip 1006 from the second channel 714*b*, the bullnose assembly 1502 may no longer be supported within the second channel 714*b* and may instead be deflected by the leading edges 116*a,b* of the plates into the first channel 714*a*.

Figure 19A:
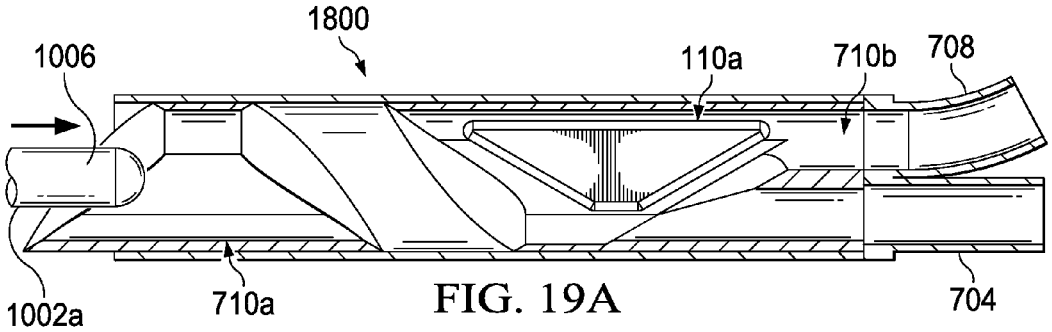
FIGS. 19A-19C illustrate cross-sectional progressive views of an exemplary deflector assembly in operation with the bullnose assembly of FIG. 10A, according to one or more embodiments.
Figure 19B:
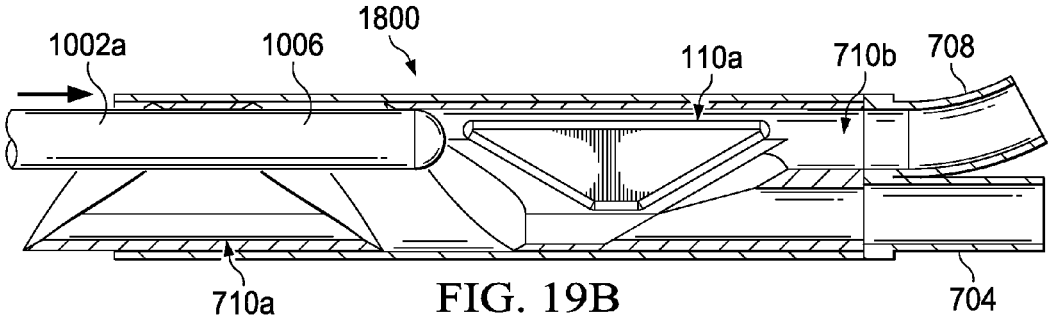
Figure 19C:
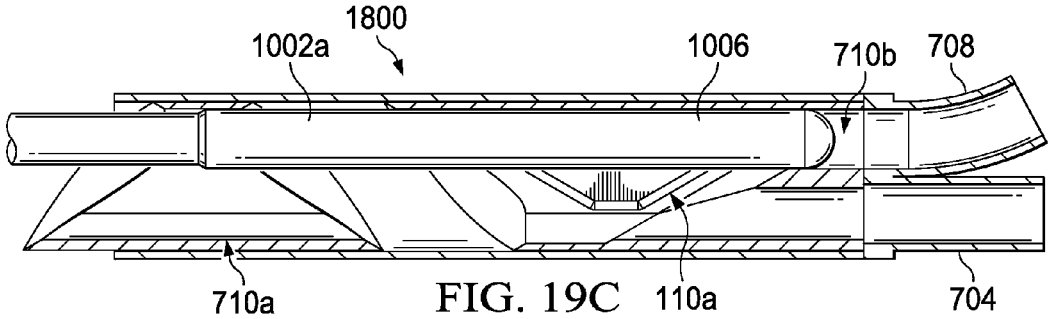

Referring now to FIGS. 19A-19C, illustrated are cross-sectional views of the deflector assembly 1800, which is illustrated in exemplary operation with bullnose assembly 1002*a*. As previously described, the structure and operation of the deflectors 710*a,b* and 110*a* are the same as that previously described with reference to the preceding figures. Again, the presence of the upper deflector 110*a* assists in providing a biasing force to the bullnose assembly 1002*b* so that it is not necessary to rely upon gravitational forces to assist with the operation of upper deflector 710*a*. In FIGS. 19A-19C, the length of the bullnose tip 1006 results in the bullnose assembly 1002*a* being directed into the lateral bore 708. Since the length 1008*a* of the bullnose tip 1006 is greater than the distance 802 that separates the upper and lower deflectors 710*a,b* (as described previously with reference to FIGS. 11A-11C), the bullnose assembly 1002*a* remains in the second channel 714*b* of the upper deflector 710*a*, and upon encountering the deflector 110*a*, the bullnose assembly 1002*a* urges apart the first and second plates 114*a,b*.

Figure 20:
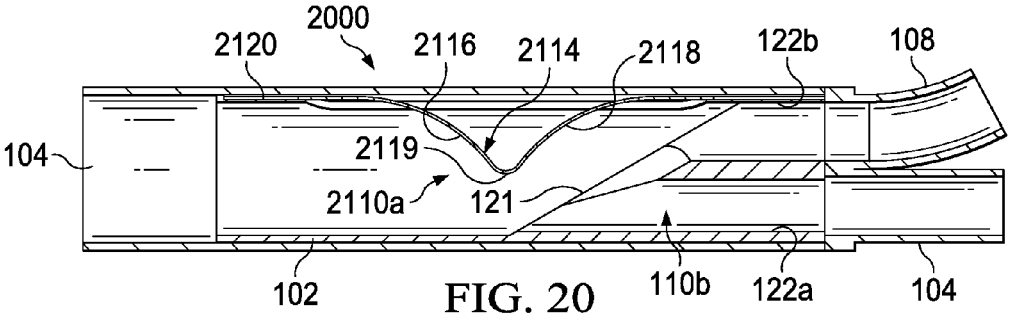
FIG. 20 illustrates a cross-sectional side view of a deflector assembly, according to one or more embodiments.

In FIG. 20, illustrated is a cross-sectional side view of an exemplary deflector assembly 2000, according to one or more embodiments of the disclosure. As illustrated, the deflector assembly 2000 includes many elements that are functionally and structurally similar to those of deflector assembly 100 (FIG. 2), and those elements are similarly numbered. One difference is the presence of an upper deflector 2110*a* that includes a guide spring 2114. The guide spring 2114 is included in lieu of first and second plates 114*a,b*. Like upper deflector 110*a*, upper deflector 2110*a* may be secured within the tubular string 102 using one or more mechanical fasteners (not shown) and the like. In other embodiments, the upper deflector 2110*a* may be welded into place within the tubular string 102, without departing from the scope of the disclosure. In yet other embodiments, the upper deflector 2110*a* may form an integral part of the tubular string 102, such as being machined out of bar stock and threaded into the tubular string 102.

As depicted, the guide spring 2114 is substantially triangular in shape and may be stamped, cast, or otherwise formed from spring steel or another resilient material. As depicted, the guide spring includes an upper ramped surface 2116 similar in function to ramped surfaces 116*a,b* (FIG. 2). A lower ramped surface 2118 converges with the upper ramped surface 2116 to form an apex 2119, which may be rounded in some embodiments.

The guide spring 2114 may be mechanically, adhesively, integrally, or otherwise attached to a portion of the tubular string 102. As depicted, the guide spring 2114 is received on each end by a guide slot 2120 formed in a wall of the tubular string 102. In some embodiments, the guide spring 2114 is permitted to slide within the guide slot 2120 such that compression of the guide spring 2114 by a bullnose assembly may result in the guide spring 2114 flattening and the guide slot 2120 receiving more of the guide spring 2114.

Figure 21A:
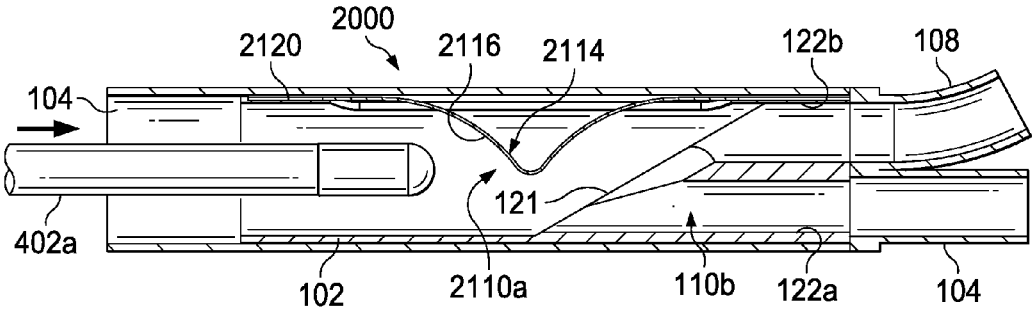
FIGS. 21A-21C illustrate cross-sectional progressive views of the exemplary deflector assembly of FIG. 20 in exemplary operation with the bullnose assembly of FIG. 4A, according to one or more embodiments.
Figure 21B:
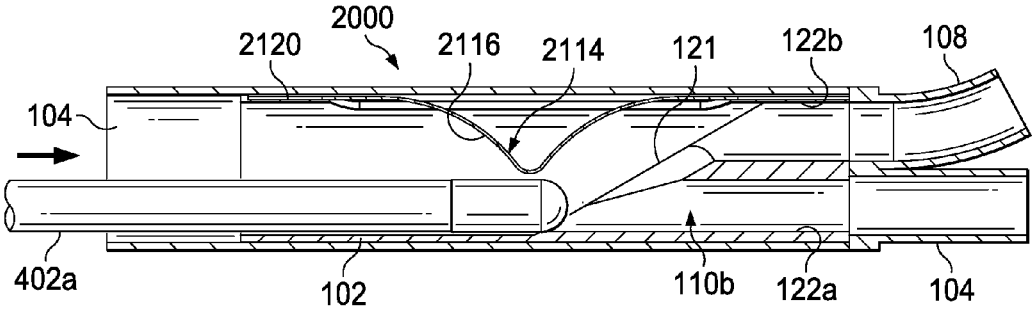
Figure 21C:
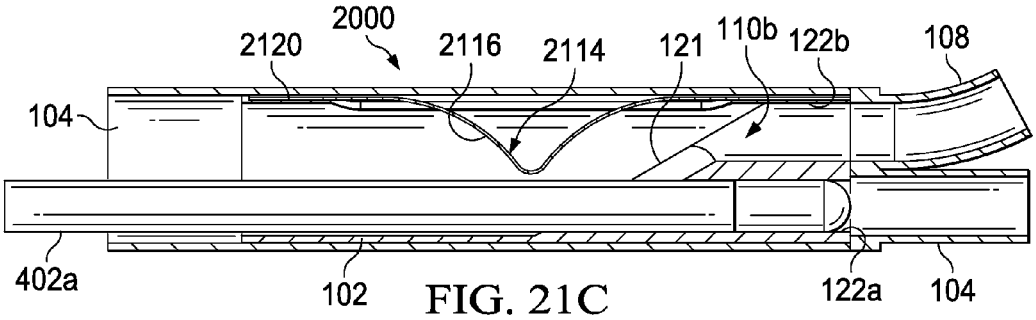

Referring to FIGS. 21A-21C, illustrated are progressive cross-sectional views of a deflector assembly 2000 the exemplary use of the deflector assembly with the bullnose assembly 402*a* described previously with reference to FIGS. 4A and 5A-5C. While the structure of upper deflector 2110*a* is different from that of upper deflector 110*a*, the operation of the upper deflector 2110*a*, and more specifically the guide spring 2114, is similar in that the guide spring 2114 assists in urging the bullnose assembly 402*a* toward a wall of the tubular string 102 and thus requires the bullnose assembly to approach the ramped surface 121 of the lower deflector 110*b* nearest the first conduit 122*a*. In FIGS. 21A-21C, the width of the bullnose tip results in the bullnose assembly 402*a* being directed into the main bore 104.

Figure 22A:
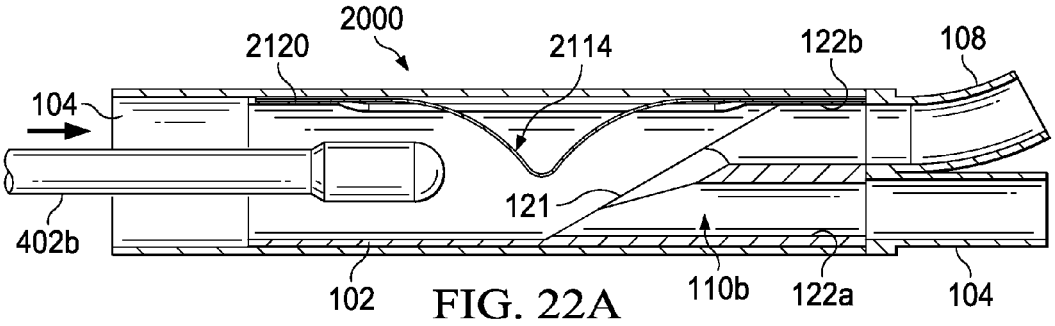
FIGS. 22A-22C illustrate cross-sectional progressive views of the exemplary deflector assembly of FIG. 20 in exemplary operation with the bullnose assembly of FIG. 4B, according to one or more embodiments.
Figure 22B:
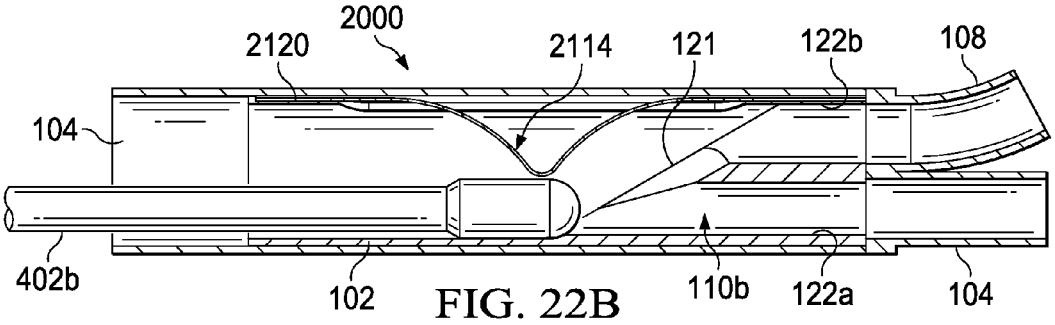
Figure 22C:
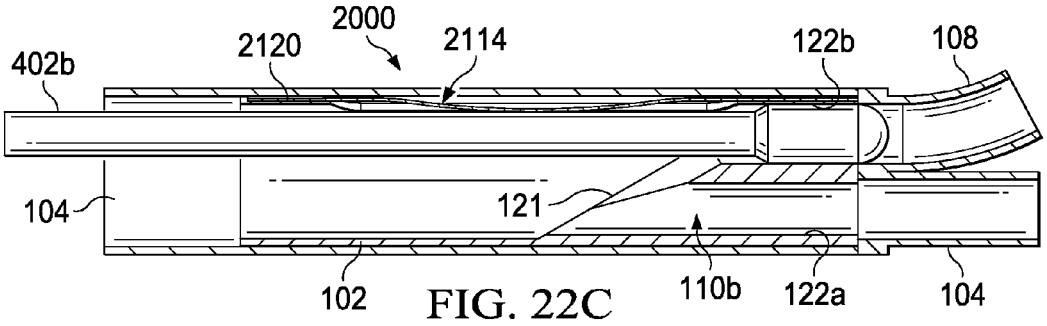
Figure 23A:
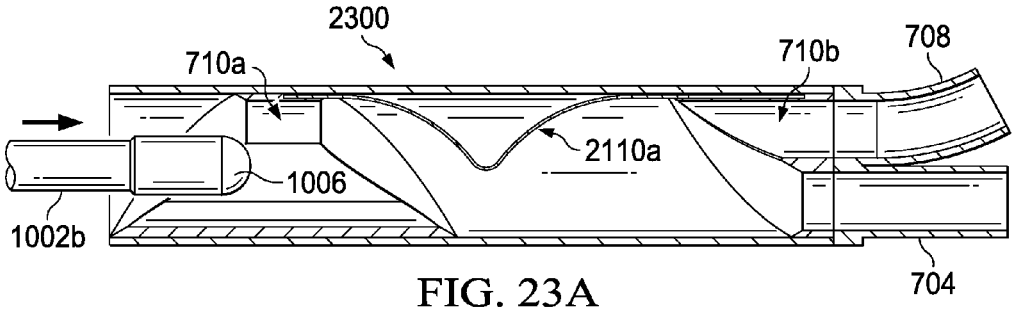
FIGS. 23A-23D illustrate cross-sectional progressive views of a deflector assembly in exemplary operation with the bullnose assembly of FIG. 10B, according to one or more embodiments.
Figure 23B:
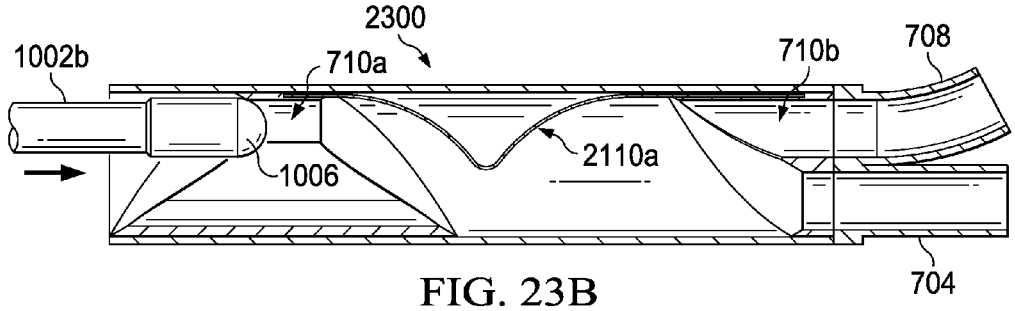
Figure 23C:
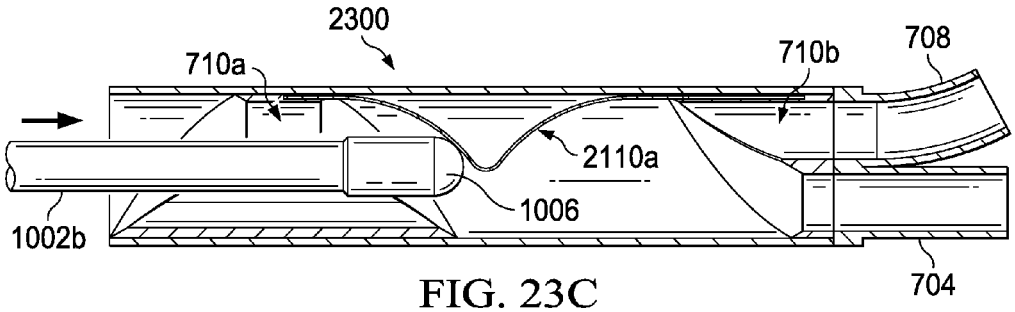
Figure 23D:
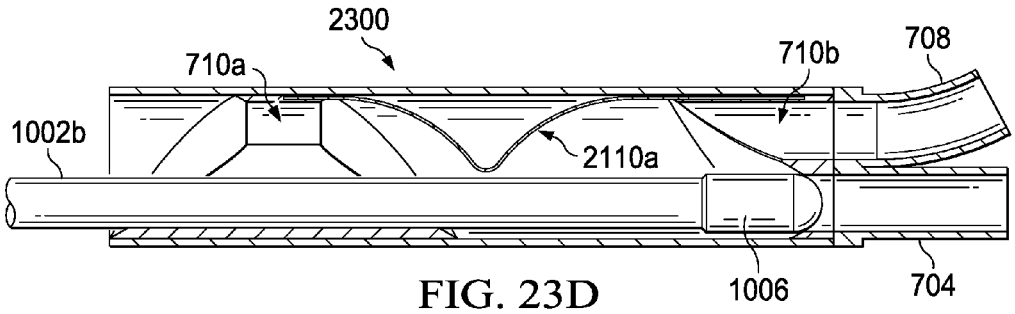

Referring to FIGS. 22A-22C, illustrated are progressive cross-sectional views of the deflector assembly 2000 and the exemplary use of the deflector assembly with the bullnose assembly 402*b* described previously with reference to FIGS. 4B and 6A-6D. Again, the guide spring 2114 assists in urging the bullnose assembly 402*b* toward the wall of the tubular string 102 and thus requires the bullnose assembly to approach the ramped surface 121 of the lower deflector 110*b* nearest the first conduit 122*a*. The ramped surface 121 then guides the bullnose assembly 402*b* toward the second conduit 122*b*. In FIGS. 22A-22C, the width of the bullnose tip results in the bullnose assembly 402*b* being directed into the lateral bore 108.

Referring now to FIGS. 23A-23D, illustrated are cross-sectional views of a deflector assembly 2300 which includes the upper and lower deflector 710*a,b* illustrated in FIGS. 7 and 8, and the upper deflector 2110*a* illustrated in FIG. 20. The structure and operation of the deflectors 710*a,b* and 2110*a* are the same as that previously described with reference to the preceding figures. One difference between the embodiments previously described and the deflector assembly 2300 illustrated in FIGS. 23A-23D is the positioning of the upper deflector 2110*a* between the upper deflector 710*a* and the lower deflector 710*b*. While the path (e.g., the main bore 704 or the lateral bore 708) the bullnose assembly enters is primarily determined by the relationship between the length of the bullnose tip 1006 and the distance between the upper and lower deflectors 710*a,b*, the presence of the upper deflector 2110*a* assists in providing a biasing force to the bullnose assembly 1002*b* so that it is not necessary to rely upon gravitational forces to assist with the operation of upper deflector 710*a*. As the bullnose tip 1006 encounters the upper deflector 2110*a*, the guide spring 2114 exerts a force on the bullnose tip 1006 urging the bullnose assembly 1002*b* into a position that aligns it with the main bore 704. In FIGS. 23A-23D, the length of the bullnose tip 1006 allows the bullnose assembly 1002*b* to be directed into the main bore 704.

Figure 24A:
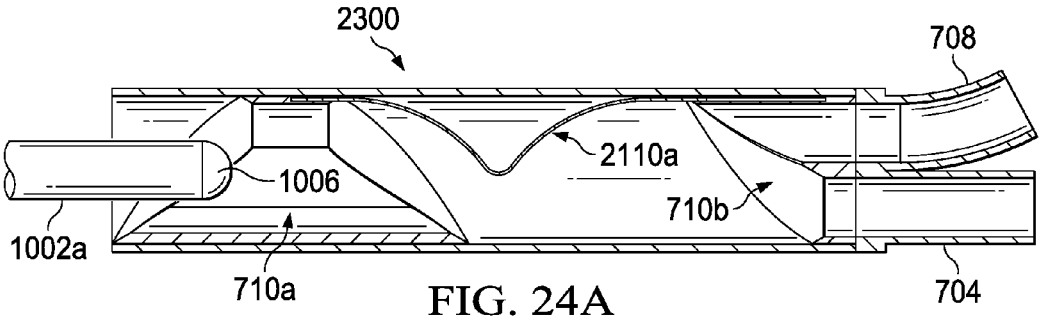
FIGS. 24A-24C illustrate cross-sectional progressive views of a deflector assembly in exemplary operation with the bullnose assembly of FIG. 10A, according to one or more embodiments.
Figure 24B:
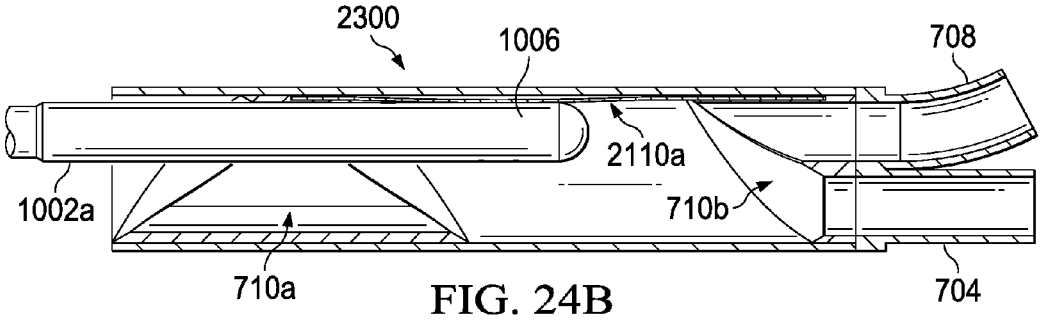
Figure 24C:
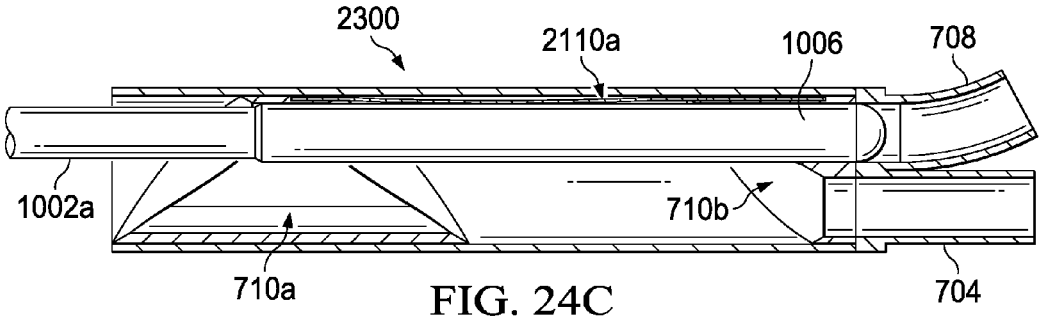

Referring now to FIGS. 24A-24C, illustrated are cross-sectional views of the deflector assembly 2300, which is illustrated in exemplary operation with bullnose assembly 1002*a*. As previously described, the structure and operation of the deflectors 710*a,b* and 2110*a* are the same as that previously described with reference to the preceding figures. Again, the presence of the upper deflector 2110*a* assists in providing a biasing force to the bullnose assembly 1002*b* so that it is not necessary to rely upon gravitational forces to assist with the operation of upper deflector 710*a*. In FIGS. 24A-24C, however, the length of the bullnose tip 1006 and the presence of deflector 710*a* prevent the upper deflector 2110*a* from deflecting the bullnose assembly 1002*b*. Instead, the bullnose assembly 1002*b* compresses the guide spring 2114 of the upper deflector 2110*a* such that the guide spring 2114 retracts as illustrated in FIGS. 24B and 24C. The bullnose assembly 1002*a* is subsequently directed into the lateral bore 708.

It is important for well operators to be able to accurately and selectively access particular lateral wellbores or a main wellbore by running downhole bullnose assemblies of known parameters. The present disclosure describes systems, assemblies, and methods for deflecting a bullnose assembly or other device downhole. In addition to the embodiments described above, many examples of specific combinations are within the scope of the disclosure, some of which are detailed below.

Example 1

A deflector assembly, comprising:

an upper deflector arranged within a main bore of a wellbore, the upper deflector having at least one plate having a ramped surface; and a lower deflector arranged within the main bore, the lower deflector defining a first conduit and a second conduit, one of the first and second conduits in communication with a lower portion of the main bore and another of the first and second conduits in communication with a lateral bore;

wherein the upper and lower deflectors are configured to direct a bullnose assembly into either the lateral bore or the lower portion of the main bore based on a size of a bullnose tip of the bullnose assembly.

Example 2

The deflector assembly of example 1, wherein the upper and lower deflectors are arranged within a tubular string that extends from a surface location.

Example 3

The deflector assembly of example 1 or 2, wherein the first conduit has a diameter smaller than a diameter of the second conduit.

Example 4

The deflector assembly of any of examples 1-3, wherein the ramped surface of the upper deflector is capable of diverting the bullnose assembly into a position that initially aligns the bullnose assembly with the first conduit.

Example 5

The deflector assembly of any of examples 1-4, wherein the bullnose tip is coupled to a distal end of a body of the bullnose assembly, the bullnose tip having a first diameter, the body of the bullnose assembly having a second diameter smaller than the first diameter.

Example 6

The deflector assembly of example 5, wherein, when the first diameter of the bullnose tip is less than the diameter of the first conduit, the bullnose tip is configured to be received within the first conduit and the bullnose assembly is directed into the lower portion of the main bore.

Example 7

The deflector assembly of example 5, wherein, when the first diameter of the bullnose tip is greater than the diameter of the first conduit, the bullnose assembly is configured to be directed into the second conduit and the lateral bore.

Example 8

The deflector assembly of example 7, wherein, when the bullnose assembly is directed toward the second conduit, at least one of the bullnose tip and the body is received between the at least one plate and a secondary member and a distance between the at least one plate and the secondary member increases.

Example 9

The deflector assembly of example 8 further comprising a biasing member to bias the at least one plate toward the secondary member.

Example 10

A method, comprising:

introducing a bullnose assembly into a main bore of a wellbore, the bullnose assembly including a body and a bullnose tip arranged at a distal end of the body, the bullnose tip having a width;

directing the bullnose assembly toward an upper deflector arranged within the main bore, the upper deflector having a ramped surface;

advancing the bullnose assembly to a lower deflector arranged within the main bore, the lower deflector defining a first conduit and a second conduit, one of the first and second conduits in communication with a lower portion of the main bore and another of the first and second conduits in communication with a lateral bore; and directing the bullnose assembly into either the lateral bore or the lower portion of the main bore based on the width of the bullnose tip.

Example 11

The method of example 10, wherein directing the bullnose assembly toward the upper deflector comprises:

engaging the bullnose tip on the ramped surface; and diverting the bullnose tip into a position that initially aligns the bullnose assembly with the first conduit.

Example 12

The method of example 10 or 11, wherein the width of the bullnose tip is a diameter, and the method further comprises:

receiving the bullnose tip within the first conduit when the diameter of the bullnose tip is less than a diameter of the first conduit.

Example 13

The method of any of examples 10-12, wherein the width of the bullnose tip is a diameter, and the method further comprises:

receiving the bullnose tip within second conduit when the diameter of the bullnose tip is greater than a diameter of the first conduit.

Example 14

A deflector assembly comprising:

a first upper deflector arranged within a main bore of a wellbore and defining first and second channels that extend longitudinally through the upper deflector, wherein the second channel exhibits a width greater than a width of the first channel;

a second upper deflector arranged within a main bore of a wellbore, the upper deflector having first and second plates spaced apart by a first distance, at least one of the first and second plates having a first ramped surface; and a lower deflector arranged within the main bore and spaced from the first upper deflector by a second distance, the lower deflector defining a first conduit that communicates with a lower portion of the main bore and a second conduit that communicates with a lateral bore, wherein the first upper, second upper, and lower deflectors are configured to direct a bullnose assembly into either the lateral bore or the lower portion of the main bore based on a length of a bullnose tip of the bullnose assembly as compared to the second distance.

Example 15

The deflector assembly of example 14, wherein the first upper, second upper, and lower deflectors are arranged within a tubular string that extends from a surface location.

Example 16

The deflector assembly of example 14 or 15, wherein the first upper deflector provides a second ramped surface facing toward an uphole direction within the main bore, the ramped surface being configured to direct the bullnose assembly into the second channel.

Example 17

The deflector assembly of any of examples 14-16, wherein the bullnose tip is coupled to a distal end of a body of the bullnose assembly, the bullnose tip exhibiting a first diameter and the body exhibiting a second diameter smaller than the first diameter and also smaller than the width of the first channel.

Example 18

The deflector assembly of any of examples 14-17, wherein the first ramped surface of the second upper deflector biases the bullnose assembly toward the first channel of the first upper deflector.

Example 19

The deflector assembly of any of examples 14-18, wherein, when the length of the bullnose tip is greater than the predetermined distance, the bullnose assembly is configured to be directed into the second conduit and the lateral bore.

Example 20

The deflector assembly of any of examples 14-19, wherein, when the length of the bullnose tip is less than the predetermined distance, the bullnose assembly is configured to be directed into the first conduit and the lower portion of the main bore.

Example 21

A deflector assembly, comprising:

an upper deflector arranged within a main bore of a wellbore, the upper deflector having first and second plates spaced apart by a first distance, at least one of the first and second plates having a ramped surface; and a lower deflector arranged within the main bore, the lower deflector defining a first conduit and a second conduit, one of the first and second conduits in communication with a lower portion of the main bore and another of the first and second conduits in communication with a lateral bore;

wherein the upper and lower deflectors are configured to direct a bullnose assembly into either the lateral bore or the lower portion of the main bore based on a size of a bullnose tip of the bullnose assembly.

Example 22

The deflector assembly of example 21, wherein the upper and lower deflectors are arranged within a tubular string that extends from a surface location.

Example 23

The deflector assembly of example 21 or 22, wherein the first conduit has a diameter smaller than a diameter of the second conduit.

Example 24

The deflector assembly of any of examples 21-23, wherein the ramped surface of the upper deflector is capable of diverting the bullnose assembly into a position that initially aligns the bullnose assembly with the first conduit.

Example 25

The deflector assembly of any of examples 21-24, wherein the bullnose tip is coupled to a distal end of a body of the bullnose assembly, the bullnose tip having a first diameter, the body of the bullnose assembly having a second diameter smaller than the first diameter.

Example 26

The deflector assembly of example 25, wherein, when the first diameter of the bullnose tip is less than the diameter of the first conduit, the bullnose tip is configured to be received within the first conduit and the bullnose assembly is directed into the lower portion of the main bore.

Example 27

The deflector assembly of example 25, wherein, when the first diameter of the bullnose tip is greater than the diameter of the first conduit, the bullnose assembly is configured to be directed into the second conduit and the lateral bore.

Example 28

The deflector assembly of example 27, wherein, when the bullnose assembly is directed toward the second conduit, at least one of the bullnose tip and the body is received between the first and second plates and a distance between the first and second plates increases to be greater than the first distance.

Example 29

The deflector assembly of any of examples 21-28 further comprising a biasing member to bias the first and second plates toward one another.

Example 30

A deflector assembly as shown and described herein.

Example 31

A method of deflecting a bullnose assembly as shown and described herein.

It should be apparent from the foregoing that embodiments of an invention having significant advantages have been provided. While the embodiments are shown in only a few forms, the embodiments are not limited but are susceptible to various changes and modifications without departing from the spirit thereof.

I claim:

1. A deflector assembly for a bullnose assembly with a bullnose tip, comprising:

an upper deflector arranged within a main bore of a wellbore, the upper deflector comprising at least one plate having a ramped surface;

a lower deflector arranged within the main bore, the lower deflector defining a first conduit and a second conduit through the lower deflector, one of the first and second conduits in communication with a lower portion of the main bore and another of the first and second conduits in communication with a lateral bore; and wherein the upper and lower deflectors are shaped and positioned to direct the bullnose assembly into either the lateral bore or the lower portion of the main bore based on a size of the bullnose tip.

2. The deflector assembly of claim 1, wherein the upper and lower deflectors are arranged within a tubular string that extends from a surface location.

3. The deflector assembly of claim 1, wherein the first conduit has a diameter smaller than a diameter of the second conduit.

4. The deflector assembly of claim 1, wherein the ramped surface of the upper deflector is shaped and positioned to divert the bullnose assembly into a position that initially aligns the bullnose assembly with the first conduit as the bullnose assembly comes into contact with the ramped surface of the upper deflector.

5. The deflector assembly of claim 1, wherein the bullnose tip is coupled to a distal end of the body of the bullnose assembly.

6. The deflector assembly of claim 1, wherein, when a diameter of the bullnose tip is less than the diameter of the first conduit, the bullnose tip is configured to be received within the first conduit and the bullnose assembly is receivable into the first conduit to be directed into the lower portion of the main bore.

7. The deflector assembly of claim 1, wherein, when a diameter of the bullnose tip is greater than the diameter of the first conduit and the lower deflector comprises a ramped surface shaped and positioned to direct the bullnose assembly toward the second conduit as the bullnose assembly travels up the ramped surface.

8. The deflector assembly of claim 7, wherein, when the diameter of the bullnose tip is greater than the diameter of the first conduit, at least one of the bullnose tip or the body is received between the at least one plate and a secondary member and a distance between the at least one plate and the secondary member is increased.

9. The deflector assembly of claim 8, further comprising a biasing member configured to bias the at least one plate toward the secondary member.

10. A method, comprising:

introducing a bullnose assembly into a main bore of a wellbore, the bullnose assembly including a body and a bullnose tip arranged at a distal end of the body, the bullnose tip having a width;

directing the bullnose assembly toward an upper deflector arranged within the main bore, the upper deflector having a ramped surface;

advancing the bullnose assembly to a lower deflector arranged within the main bore, the lower deflector defining a first conduit and a second conduit through the lower deflector, one of the first and second conduits in communication with a lower portion of the main bore and another of the first and second conduits in communication with a lateral bore; and directing the bullnose assembly into either the lateral bore or the lower portion of the main bore based on the width of the bullnose tip.

11. The method of claim 10, wherein directing the bullnose assembly toward the upper deflector comprises:

engaging the bullnose tip on the ramped surface; and diverting the bullnose tip into a position that initially aligns the bullnose assembly with the first conduit.

12. The method of claim 10, wherein the width of the bullnose tip is a diameter of the bullnose tip, and the method further comprises: receiving the bullnose tip within the first conduit when the first diameter of the bullnose tip is less than a diameter of the first conduit.

13. The method of claim 10, wherein the width of the bullnose tip is a diameter of the bullnose tip, and the method further comprises: receiving the bullnose tip within second conduit when the diameter of the bullnose tip is greater than a diameter of the first conduit.

14. A deflector assembly comprising:

a first upper deflector arranged within a main bore of a wellbore and defining first and second channels that extend longitudinally through the first upper deflector, wherein the second channel exhibits a width greater than a width of the first channel;

a second upper deflector arranged within the main bore, the second upper deflector comprising first and second plates spaced apart by a first distance, at least one of the first plate or the second plate having a first ramped surface; and a lower deflector arranged within the main bore and spaced from the first upper deflector by a second distance, the lower deflector defining a first conduit through the lower the deflector that communicates with a lower portion of the main bore and a second conduit through the lower deflector that communicates with a lateral bore;

wherein the first upper, second upper, and lower deflectors are configured to direct a bullnose assembly into either the lateral bore or the lower portion of the main bore based on a length of a bullnose tip of the bullnose assembly as compared to the second distance.

15. The deflector assembly of claim 14, wherein the first upper, second upper, and lower deflectors are arranged within a tubular string that extends from a surface location.

16. The deflector assembly of claim 14, wherein the first upper deflector comprises a second ramped surface facing toward an uphole direction within the main bore, the ramped surface being shaped and positioned to direct the bullnose assembly into the second channel.

17. The deflector assembly of claim 14, wherein the bullnose tip is coupled to a distal end of a body of the bullnose assembly, the bullnose tip exhibiting a first diameter and the body exhibiting a second diameter smaller than the first diameter and also smaller than the width of the first channel.

18. The deflector assembly of claim 14, wherein the first ramped surface of the second upper deflector biases the bullnose assembly toward the first channel of the first upper deflector.

19. The deflector assembly of claim 14, wherein, when the length of the bullnose tip is greater than the predetermined distance, the bullnose assembly is configured to be directed into the second conduit and the lateral bore.

20. The deflector assembly of claim 14, wherein, when the length of the bullnose tip is less than the predetermined distance, the bullnose assembly is configured to be directed into the first conduit and the lower portion of the main bore.

* * * * *